US011351793B2

(12) United States Patent
Miyazawa et al.

(10) Patent No.: US 11,351,793 B2
(45) Date of Patent: Jun. 7, 2022

(54) RECORDING APPARATUS

(71) Applicant: SEIKO EPSON CORPORATION, Tokyo (JP)

(72) Inventors: Seiji Miyazawa, Matsumoto (JP); Hisayuki Akahane, Matsumoto (JP); Shintaro Miyamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/880,403

(22) Filed: May 21, 2020

(65) Prior Publication Data

US 2020/0369038 A1 Nov. 26, 2020

(30) Foreign Application Priority Data

May 24, 2019 (JP) ..... JP2019-097494

(51) Int. Cl.
*B41J 2/175* (2006.01)

(52) U.S. Cl.
CPC ..... *B41J 2/17553* (2013.01)

(58) Field of Classification Search
CPC .... B41J 2/17553; B41J 29/02; B41J 2/17509; B41J 29/13; B41J 2/17566; B41J 2/01
USPC ..... 347/86
See application file for complete search history.

(56) References Cited

U.S. PATENT DOCUMENTS

2008/0297571 A1 12/2008 Umeda
2018/0272731 A1 9/2018 Kimura et al.
2018/0272774 A1* 9/2018 Kudo ..... B41J 29/17
2019/0105903 A1* 4/2019 Kimura ..... B41J 2/16538

FOREIGN PATENT DOCUMENTS

JP 2008-296508 12/2008
JP 2018-161851 10/2018

* cited by examiner

*Primary Examiner* — Kristal Feggins
*Assistant Examiner* — Alexander D Shenderov
(74) *Attorney, Agent, or Firm* — Workman Nydegger

(57) ABSTRACT

A recording apparatus includes a carriage, a liquid container provided on the carriage and in which a liquid is to be injected, the liquid container having a liquid level check portion through which a level of the liquid in the liquid container is visually checked, a recording head disposed in the carriage, and an operation panel disposed on a front surface of the apparatus along the width direction, the operation panel and an exposure section through which the liquid level check portion is exposed are disposed such that the operation panel and the exposure section are visually checked, and the carriage is moved from a home position toward the exposure section and the operation panel and the liquid level check portion are arranged in the width direction when the apparatus side surface is viewed from the front side.

13 Claims, 23 Drawing Sheets

RECORDING APPARATUS

The present application is based on, and claims priority from JP Application Serial Number 2019-097494, filed May 24, 2019, the disclosure of which is hereby incorporated by reference herein in its entirety.

BACKGROUND

1. Technical Field

The present disclosure relates to a recording apparatus for performing recording onto a recording medium.

2. Related Art

Various recording apparatuses, for example, ink jet printers are provided. Among such ink jet printers, some ink jet printers include a recording head for discharging an ink, which is an example liquid, onto a recording medium, and a liquid container for storing the ink to be supplied to the recording head. The liquid container can be refilled with the ink after the ink has been consumed by recording.

JP-A-2018-161851 discloses a recording apparatus that includes a liquid storage section that allows users to visually check a liquid level of an ink in the liquid storage section. The recording apparatus in JP-A-2018-161851 has a level check portion on a right end portion of an apparatus front side, and users can visually check a liquid level of the ink from the outside of the apparatus.

In refilling the liquid storage section with the ink, the user operates an operation panel, in particular, when the operation panel has a display device, the user operates the operation panel in accordance with a user interface that is displayed on the display device to refill the liquid storage section with the ink. The recording apparatus described in JP-A-2018-161851, however, is susceptible to improvement in efficiency in the operation panel operation and ink refilling operation.

SUMMARY

According to an aspect of the present disclosure to solve the above-described problem, a recording apparatus includes a carriage configured to be moved in a first direction that is one of directions in a width direction intersecting a transport direction of a recording medium and in a second direction that is an opposite direction of the first direction, a liquid container provided on the carriage and in which a liquid is to be injected, the liquid container having a liquid level check portion through which a level of the liquid in the liquid container is visually checked, a recording head disposed in the carriage, the recording head into which the liquid is supplied from the liquid container, and the recording head being configured to discharge the liquid onto the recording medium, and an operation panel disposed on a side surface of the apparatus along the width direction. When the apparatus side surface is viewed from the front side, the operation panel and an exposure section through which the liquid level check portion is exposed are disposed such that the operation panel and the exposure section are visually checked, and the carriage is moved from a home position in which the carriage is capped by the recording head toward the exposure section and the operation panel and the liquid level check portion are arranged in the width direction when the apparatus side surface is viewed from the front side.

DESCRIPTION OF EXEMPLARY EMBODIMENTS

Figure 1:
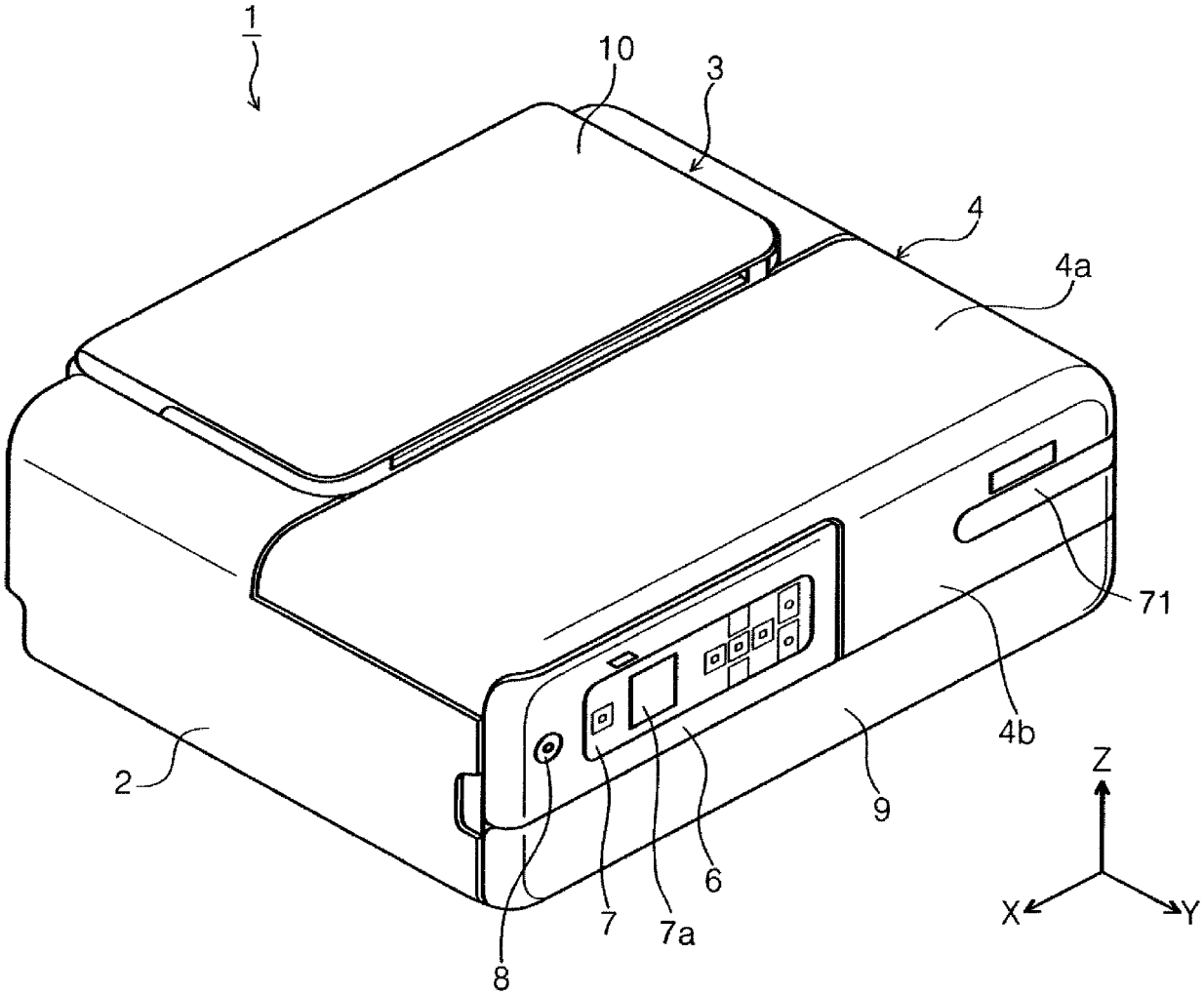
FIG. 1 is an external perspective view of a printer in which a rear top cover, a front top cover, and a front cover are closed.

Hereinafter, aspects of the present disclosure will be described. According to a first aspect, a recording apparatus includes a carriage configured to be moved in a first direction that is one of directions in a width direction intersecting a transport direction of a recording medium and in a second direction that is an opposite direction of the first direction, a liquid container provided on the carriage and in which a liquid is to be injected, the liquid container having a liquid level check portion through which a level of the liquid in the liquid container is visually checked, a recording head disposed in the carriage, the recording head into which the liquid is supplied from the liquid container, and the recording head being configured to discharge the liquid onto the recording medium, and an operation panel disposed on a side surface of the apparatus along the width direction. When the apparatus side surface is viewed from the front side, the operation panel and an exposure section through which the liquid level check portion is exposed are disposed such that the operation panel and the exposure section are visually checked, and the carriage is moved from a home position in which the carriage is capped by the recording head toward the exposure section and the operation panel and the liquid level check portion are arranged in the width direction when the apparatus side surface is viewed from the front side.

According to the aspect, when the apparatus side surface is viewed from the front side, the operation panel and an exposure section through which the liquid level check portion is exposed are disposed such that the operation panel and the exposure section are visually checked, and the carriage is moved from a home position toward the exposure section and the operation panel and the liquid level check portion are arranged in the width direction when the apparatus side surface is viewed from the front side. With this structure, in a liquid injection operation for injecting the liquid into the liquid container, the liquid level check portion becomes close to the operation panel, and thus the user turns his/her eyes less frequently while operating the operation panel and injecting the liquid. Accordingly, the user can more readily inject the liquid.

In a second aspect, in the first aspect, when the apparatus side surface is viewed from the front side, from an end portion in the second direction toward the first direction, the operation panel, the exposure section, and the home position may be disposed in this order.

In a third aspect, in the first or second aspect, above the carriage, a top cover that serves as a top panel of the apparatus when the top cover is closed and exposes an upper portion of the carriage when the top cover is open may be disposed. The top cover may have a side surface forming section that serves as the apparatus side surface together with the operation panel, and when the top cover is closed, the side surface forming section may cover the exposure section, and when the top cover is open, the side surface forming section may expose the exposure section.

According to the aspect, the top cover has the side surface forming section, and when the top cover is closed, the side surface forming section covers the exposure section, and when the top cover is open, the side surface forming section exposes the exposure section. With this structure, dust can be prevented from entering the inside of the apparatus through the exposure section even though the exposure section has the opening. The exposure section that has the opening enables users to directly and visually check the liquid level check portion, and as compared with the exposure section made of, for example, a transparent plate, the visibility of the liquid level check portion can be increased and the liquid level can be visually and more reliably checked. Furthermore, in a case in which the side surface forming section is a single component and is opened or closed, in addition to an open/close operation of the top cover, an open/close operation of the side surface forming section is to be performed. However, since the side surface forming section is provided together with the top cover, the space above the carriage can be exposed and the exposure section can be exposed by a single operation, and thus the operability can be increased.

In a fourth aspect, in the third aspect, the exposure section may be a space between a first wall section located at an end in the first direction and a second wall section located in the second direction with respect to the first wall section, and the operation panel may be configured to be tilted with respect to the second wall section with a first hinge and a second hinge that is farther from the exposure section than the first hinge.

According to the aspect, in a structure in which the operation panel is configured to be tilted with respect to the second wall section with a first hinge and a second hinge that is farther from the exposure section than the first hinge, the operational effects according to the above-described first aspect or the second aspect can be obtained.

In a fifth aspect, in the fourth aspect, between the first hinge and the second hinge, the second hinge may be a torque hinge that is configured to keep a tilt angle of the operation panel.

According to the aspect, this structure has the exposure section, that is, a space in the first direction with respect to the second wall section, and the first direction side of the second wall section has no support and tends to be bent. Accordingly, if a torque hinge is used at this position, the second wall section may be bent due to the torque produced when the operation panel is tilted. However, in this aspect, between the first hinge and the second hinge, the second hinge that is farther from the exposure section is a torque hinge, and thus bending of the second wall section can be reduced in tilting the operation panel.

In a sixth aspect, in any one of the third to the fifth aspects, the side surface forming section may have a light emitting section configured to light up or blink to indicate a status of the apparatus. According to this aspect, the side surface forming section has a light emitting section configured to light up or blink to indicate a status of the apparatus, and thus the user can readily grasp the status of the apparatus.

In a seventh aspect, in the sixth aspect, the top cover may have a wire cover that covers a wire that is electrically coupled to the light emitting section, and the center of gravity of the wire cover may be close to a rotation shaft of the top cover.

According to the aspect, the top cover has a wire cover that covers a wire that is electrically coupled to the light emitting section, and the center of gravity of the wire cover is close to a rotation shaft of the top cover. With this structure, as compared with a structure in which the center of gravity of the wire cover is close to a free end of the top cover, the impact due to the top cover that is closed unintentionally can be suppressed.

In an eighth aspect, in any one of the third to the seventh aspects, the top cover may be configured to be opened from a closed state to an open limit by being turned to a rotation angle larger than 90°. According to this aspect, the top cover can be opened from a closed state to an open limit by being turned to a rotation angle larger than 90°, and thus the top cover can be reliably kept open.

In a ninth aspect, in any one of the third to the eighth aspects, the recording apparatus may further include an open/close sensor configured to detect a closed state of the top cover by being pressed by a protrusion on the side surface forming section. The open/close sensor may be disposed in a slit into which the protrusion is inserted, and in a state in which the top cover is closed, the protrusion may be engaged in the slit to regulate at least a position of the top cover in the width direction.

According to this aspect, the side surface forming section has a protrusion and in a state in which the top cover is closed, the protrusion is engaged in the slit to regulate at least a position of the top cover in the width direction. With this structure, rattling of the top cover can be suppressed.

In a tenth aspect, in any one of the third to the ninth aspects, the recording apparatus may further include an apparatus body having the carriage, and a document reading mechanism section having a reading section configured to read a document and a document transport section configured to transport the document to the reading section, the document reading mechanism section being disposed in an upper part of the apparatus body. The top cover is rotatably coupled to a frame of the document reading mechanism section.

According to this aspect, in the structure in which the top cover is rotatably coupled to a frame of the document reading mechanism section, any one the effects in the above-described second to eighth aspects can be achieved.

In an eleventh aspect, in any one of the third to the tenth aspects, the recording apparatus may further include a holding section configured to hold the top cover that is open. The holding section is disposed in the top cover, and includes a plunger configured to be slid in a direction of the radius of gyration of the top cover that is opened or closed by being turned, and a pressing member disposed in the top cover. The pressing member is configured to press the plunger, and the plunger is pressed against a contact portion disposed to face the plunger to hold the top cover that is open.

In a twelfth aspect, in any one of the first to eleventh aspects, the recording apparatus may further include a cover member that covers a part of an upper portion of the carriage along the moving direction of the carriage. The cover member has a notch in a portion in the moving direction of the carriage, and on the notch, a detachable cover member is disposed.

Hereinafter, embodiments of the present disclosure will be described in detail. In the drawings, an X-axis direction denotes an apparatus width direction. A −X direction denotes a right direction when viewed from a user who is facing an apparatus front side, and similarly, a +X direction denotes a left direction. In the embodiments, the −X direction is referred to as a first direction, and the +X direction is referred to as a second direction.

Furthermore, the X-axis direction is a direction that intersects a sheet transport direction in an area facing a recording head 22 in an apparatus body 2, which will be described below, that is, a sheet width direction. A Y-axis direction denotes an apparatus depth direction. A +Y direction denotes a direction from the apparatus rear side toward the apparatus front side, and a −Y direction denotes a direction from the apparatus front toward the apparatus rear side. In the embodiments, among side surfaces of the apparatus, a side surface that has a tilt panel 6 is referred to as the apparatus front side, and a side surface that is opposite to the apparatus front side is referred to as the apparatus rear side. Furthermore, in the Y-axis directions, the +Y direction is the sheet transport direction in the area facing the recording head 22 in the apparatus body 2, which will be described below. A Z axis denotes a vertical direction, and a +Z direction denotes a vertically upward direction, and a −Z direction denotes a vertically downward direction.

Figure 2:
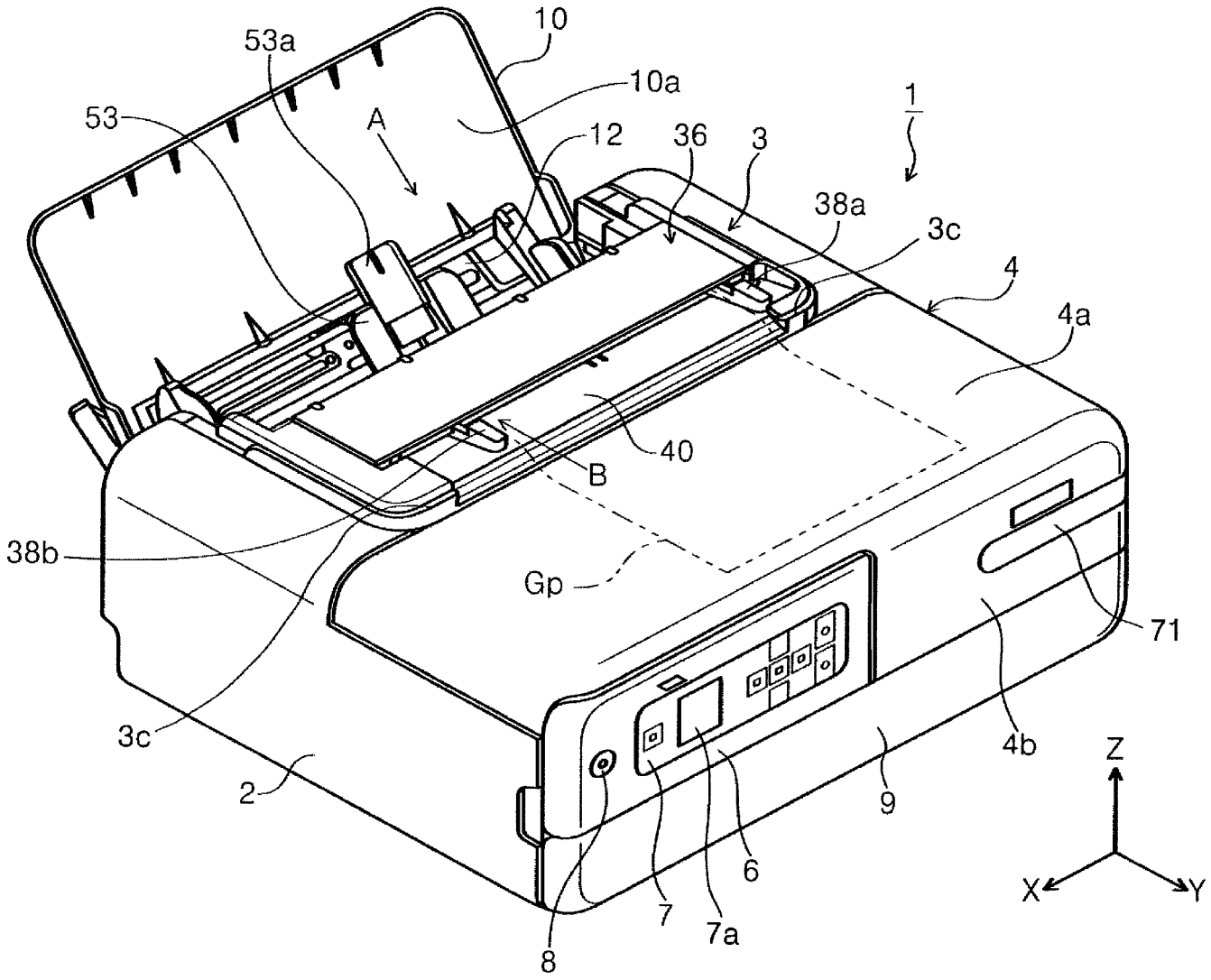
FIG. 2 is an external perspective view of a printer in which a rear top cover is open, and a front top cover and a front cover are closed.

In FIG. 1 and FIG. 2, an ink jet printer 1, which is an example recording apparatus, is a multifunction peripheral that includes a reading mechanism section 3 that is disposed in an upper part of the apparatus body 2 and is configured to read a document. Hereinafter, the ink jet printer 1 is simply referred to as a "printer 1". The apparatus body 2 has a function to perform recording onto a recording sheet, which is an example recording medium. The reading mechanism section 3 has a function to read a document.

Among the side surfaces of the apparatus body 2, on the apparatus front side that is a side along the X-axis direction, the apparatus body 2 has the tilt panel 6. The tilt panel 6 has a power button 8 to be used to turn on or off the power of the printer 1 and an operation section 7 to be used to perform various operations. The tilt panel 6 is an example operation panel. The operation section 7 includes a display section 7*a* that provides various kinds of information display. The color of the tilt panel 6 is darker than that of the apparatus body 2 (for example, white or a color close to white), for example, black or a color close to black. By the colors, the tilt panel 6 and the operation section 7 can be easily distinguished. The tilt panel 6 can be tilted by being turned around a left hinge 69A and a right hinge 69B illustrated in FIG. 14 and FIG. 15. The apparatus front side also includes a front cover 9, and the front cover 9 can be turned around a rotation shaft 9*a* (see FIG. 11) to a closed position as illustrated in FIG. 1 to FIG. 3 or to an open position at which a discharge path for discharging a recorded recording sheet is exposed as illustrated in FIG. 4.

Figure 7:
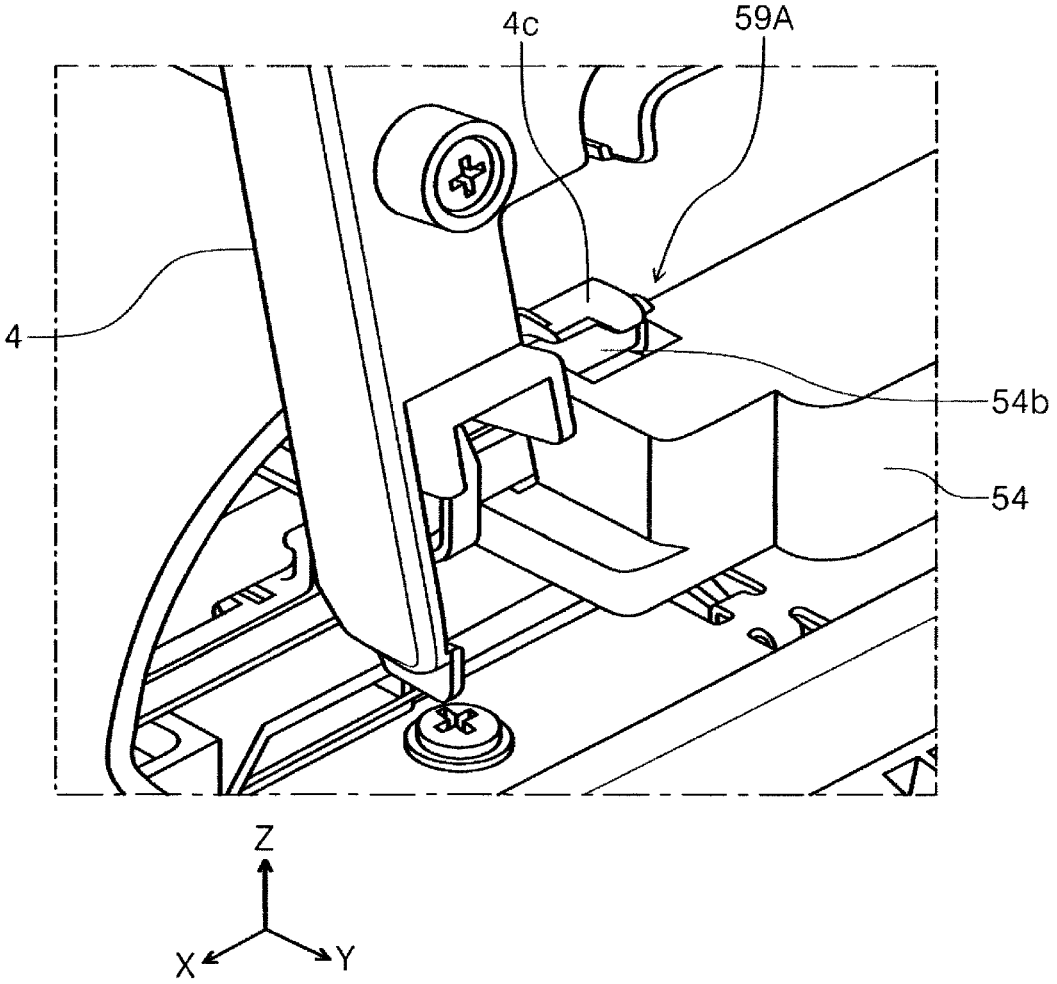
FIG. 7 is a perspective view of a left coupling section.
Figure 8:
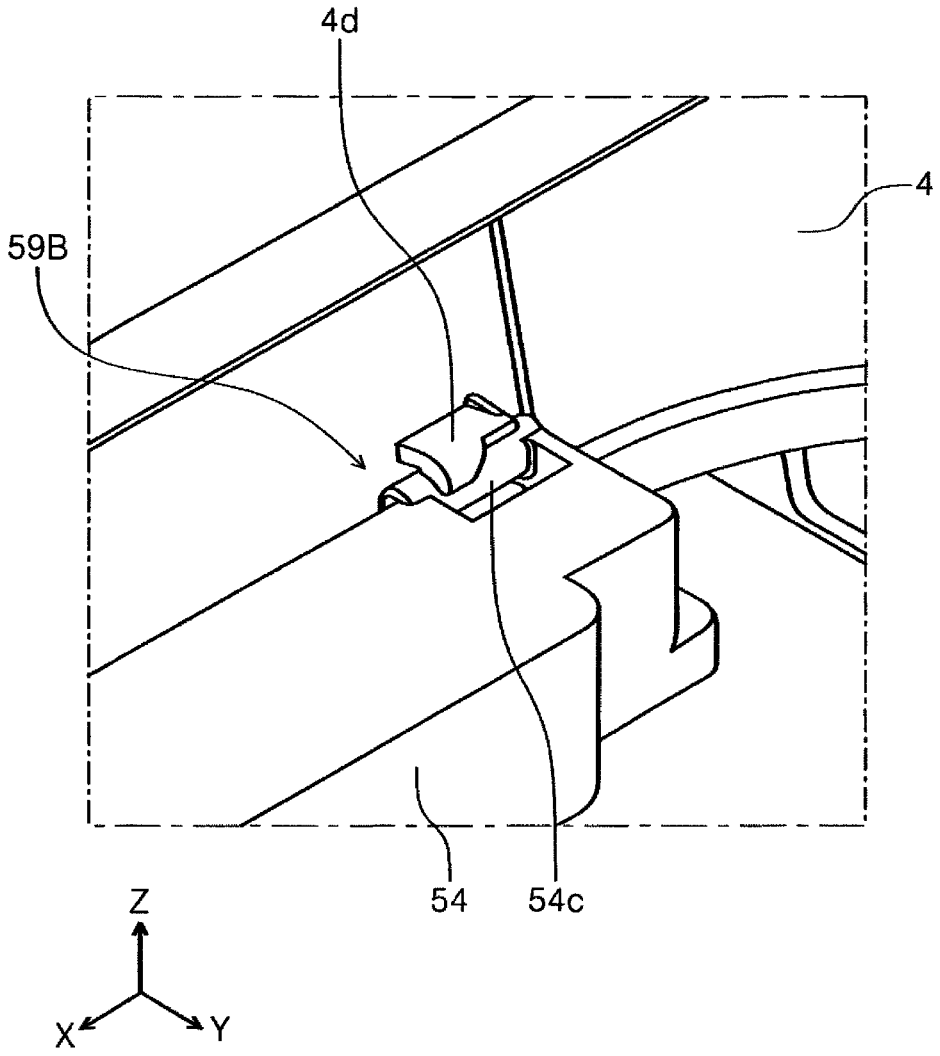
FIG. 8 is a perspective view of a right coupling section.

The apparatus body 2 includes a front top cover 4 that is a front side of a top surface and is used as a top cover. The front top cover 4 is rotatably coupled to a holding frame 54 of the reading mechanism section 3 at a left coupling section 59A illustrated in FIG. 7 and a right coupling section 59B illustrated in FIG. 8. As illustrated in FIG. 7, the left coupling section 59A includes a left-shaft section 54*b* in the holding frame 54 and a left-shaft fitting section 4*c* in the front top cover 4. As illustrated in FIG. 8, the right coupling section 59B includes a right-shaft section 54*c* in the holding frame 54 and a right-shaft fitting section 4*d* in the front top cover 4. The left-shaft section 54*b* and the right-shaft section 54*c* serve as a rotation shaft of the front top cover 4. The front top cover 4 can be turned to a closed position as illustrated in FIG. 1 and FIG. 2, and to an open position at which the inside of the apparatus body 2, in particular, a carriage 60 is exposed as illustrated in FIG. 3 and FIG. 4. Opening the front top cover 4 allows the user, for example, to remove a stacked recording sheet or to refill an ink tank 61, which serves as a liquid storage section described below, with ink.

The front top cover 4 is formed with a side surface forming section 4*b* in one piece. An upper surface 4*a* of the front top cover 4 and the side surface forming section 4*b* are at substantially right angles, and when the front top cover 4 is closed and the tilt panel 6 is closed, the surface of the side surface forming section 4*b* is flush with the surface of the tilt panel 6 as illustrated in FIG. 1 and FIG. 2. The side surface forming section 4*b* includes a status indication section 71. The status indication section 71 is a light emitting section for indicating various states of the printer 1 by using a light emitting component such as a light-emitting diode (LED). For example, the status indication section 71 lights up when the power is turned on and blinks when an error occurs. The errors to be indicated by blinking of the status indication section 71 in this embodiment includes, for example, out of paper, a paper jam, out of ink, and waste liquid (described below) counter overflow. The error types may be indicated by different blinking intervals or different display colors. The status indication section 71 enables the user to readily grasp the status of the apparatus. The color of the status indication section 71 is darker than the color (for example, white or a color close to white) of the side surface forming section 4*b*, for example, black or a color close to black to emphasize the light emission. Accordingly, the user can readily grasp the status of the apparatus.

Figure 3:
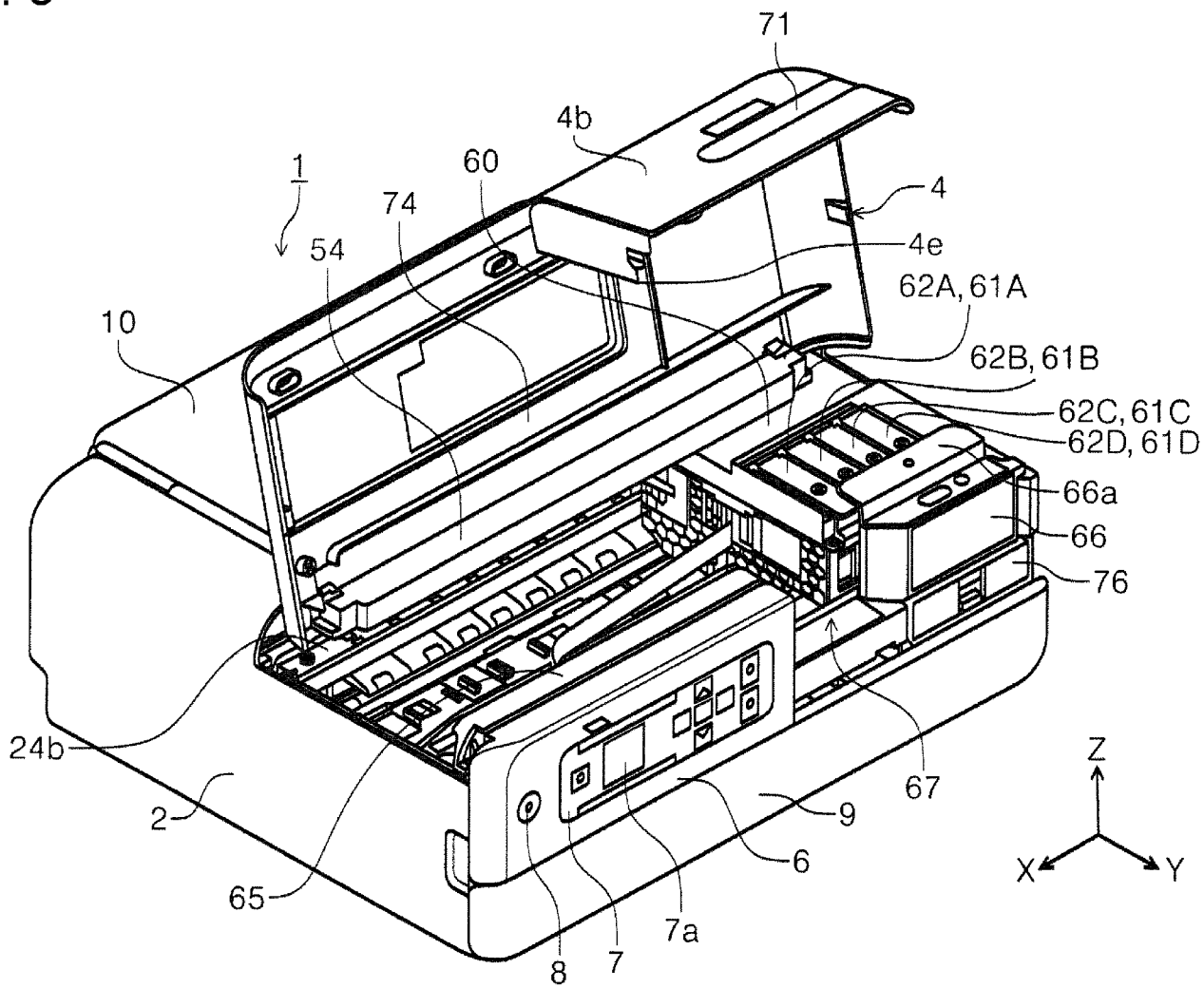
FIG. 3 is an external perspective view of a printer in which a rear top cover and a front cover are closed, and a front top cover is open.
Figure 4:
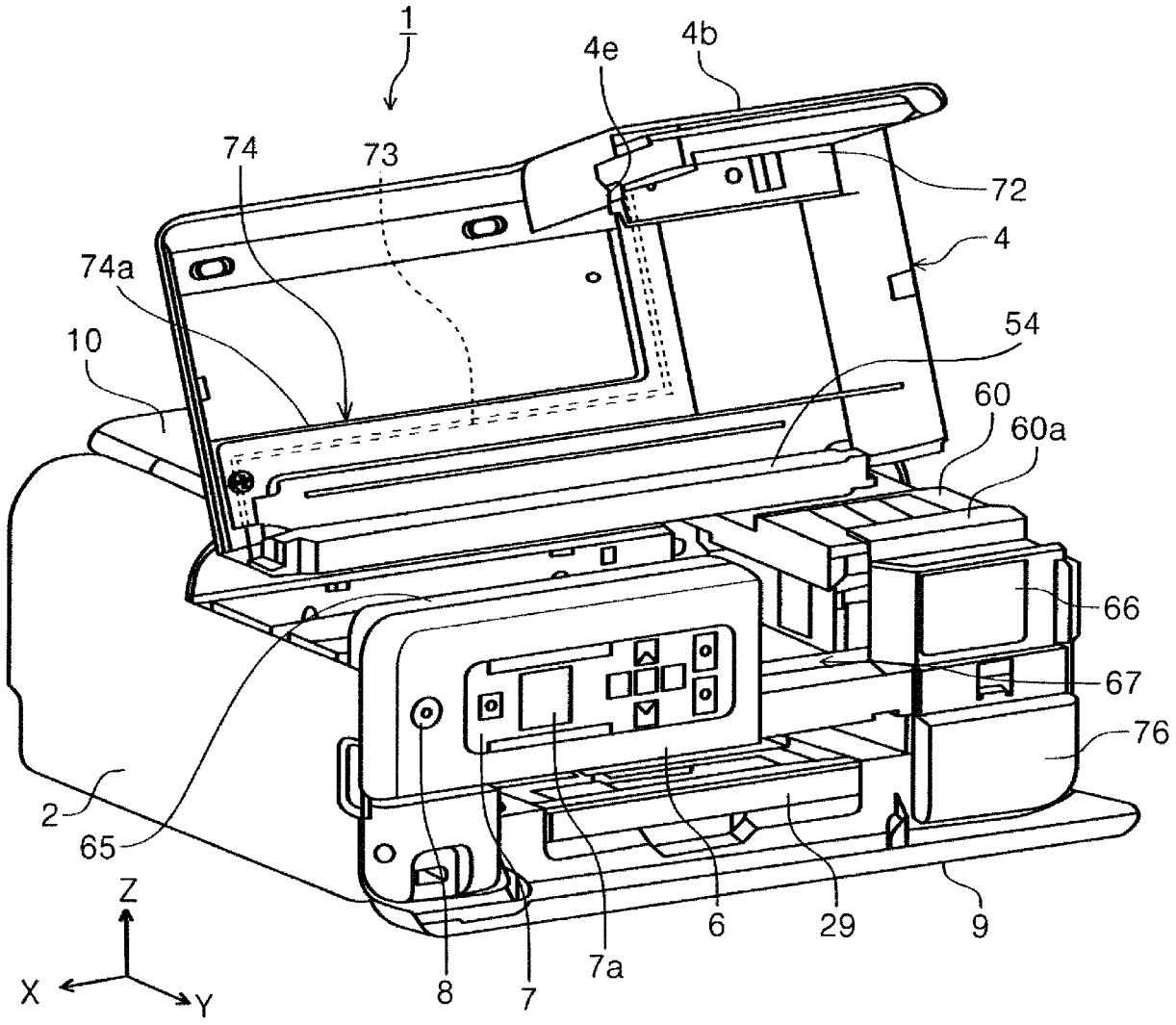
FIG. 4 is an external perspective view of a printer in which a rear top cover is closed, and a front top cover and a front cover are open.
Figure 9:
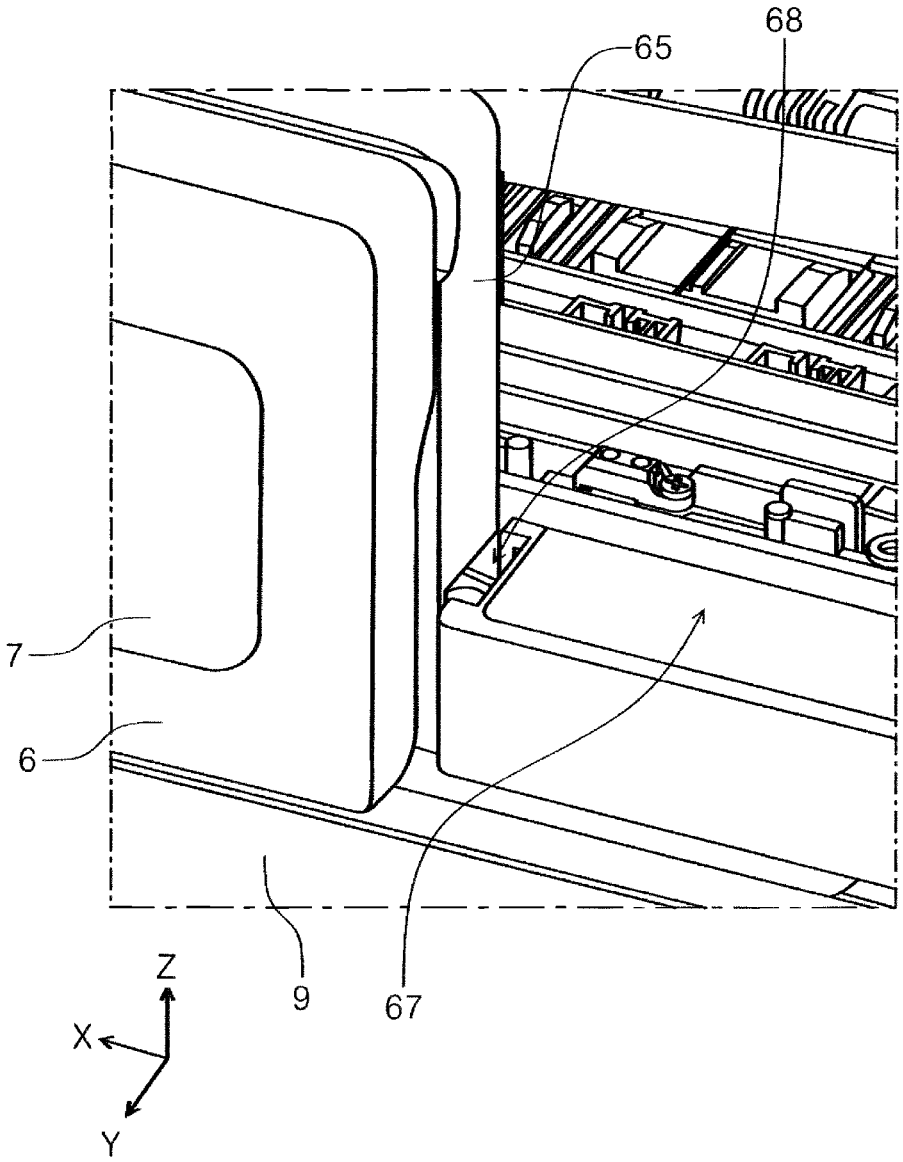
FIG. 9 is a perspective view of a slit into which a protrusion of a front top cover is inserted.
Figure 10:
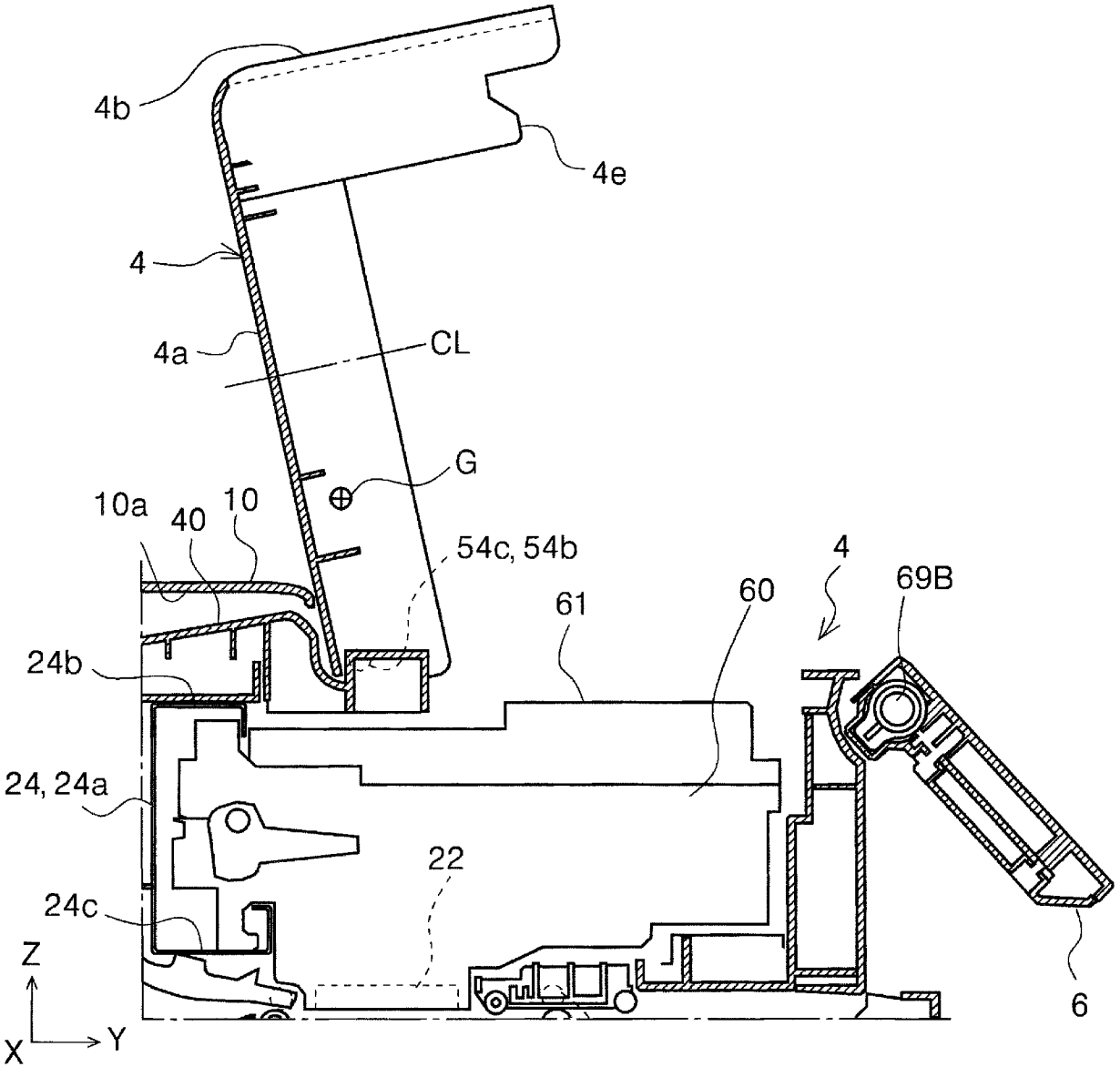
FIG. 10 is a side cross-sectional view of an apparatus in which a front top cover is open and a tilt panel is tilted.

The side surface forming section 4*b* has a sensor pressing portion 4*e* in a side portion in the +X direction as illustrated in FIG. 3, FIG. 4, and FIG. 10. The sensor pressing portion 4*e* is a protrusion and is inserted into a slit 68 illustrated in FIG. 9 when the front top cover 4 is closed. The sensor pressing portion 4*e* that has been inserted into the slit 68 presses an open/close sensor 84 (see FIG. 16) to inform a controller 80 (see FIG. 16) of the printer 1 that the front top cover 4 has been closed. When the front top cover 4 is closed, the sensor pressing portion 4*e* is engaged in the slit 68, and thereby the position of the front top cover 4 in the X-axis direction is regulated and thus rattling of the front top cover 4 in the X-axis direction can be suppressed. In this embodiment, the position of the front top cover 4 in the Y-axis direction is also regulated and rattling of the front top cover 4 in the Y-axis direction can also be suppressed.

Below the tilt panel 6 and the side surface forming section 4*b*, the front cover 9 is openably and closably disposed. FIG. 1 to FIG. 3 illustrate the front cover 9 that is closed, and FIG. 4 illustrates the front cover 9 that is open. When the front cover 9 is closed, the surface of the front cover 9, the surface of the side surface forming section 4*b*, and the surface of the tilt panel 6 are flush with each other, forming an apparatus side surface that extends vertically. Opening the front cover 9 allows the user to extend a discharge tray 29 that receives a recording sheet discharged toward the apparatus front side as illustrated in FIG. 4.

Figure 11:
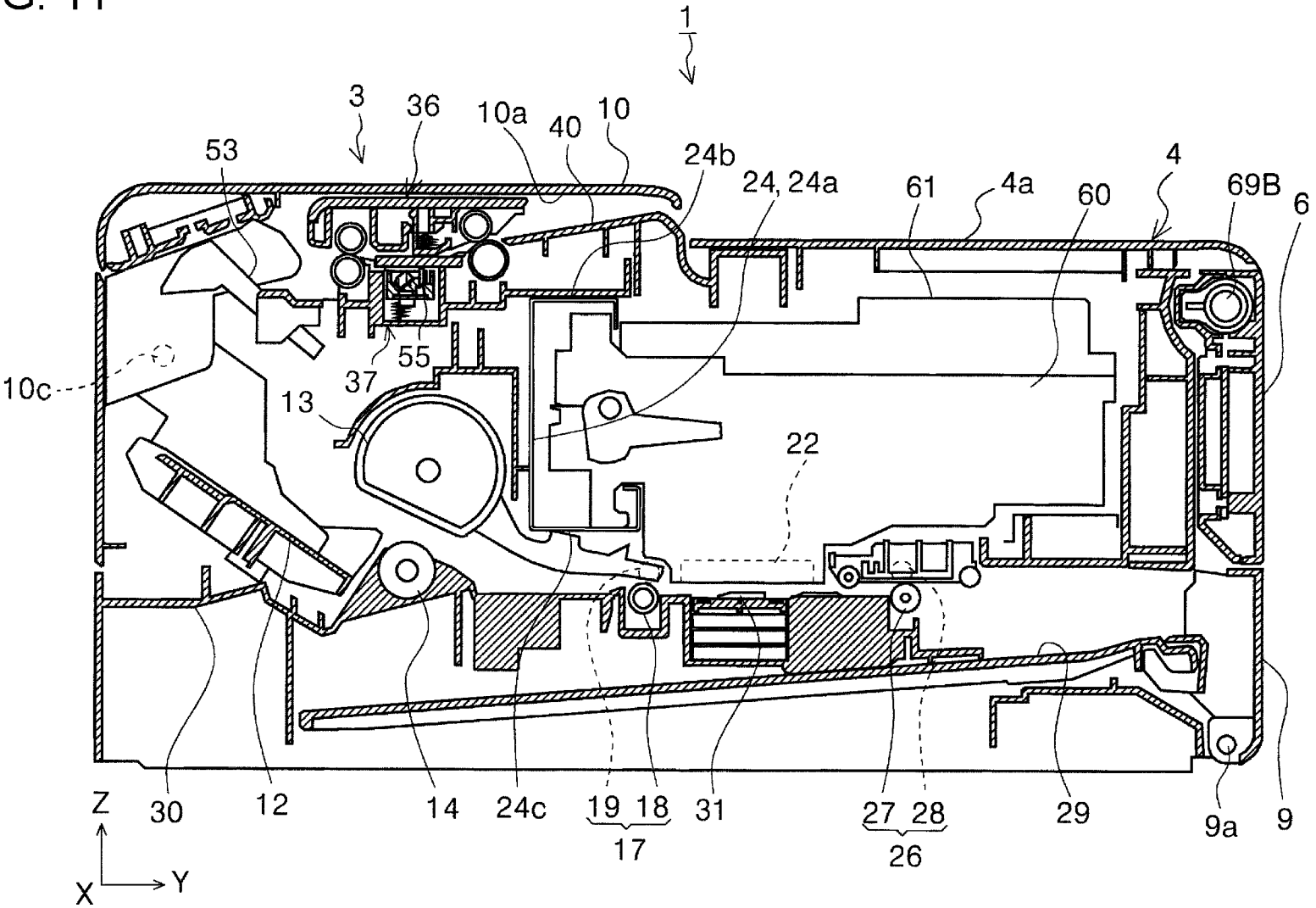
FIG. 11 is a side cross-sectional view of a printer in which a rear top cover, a front top cover, and a front cover are closed.
Figure 12:
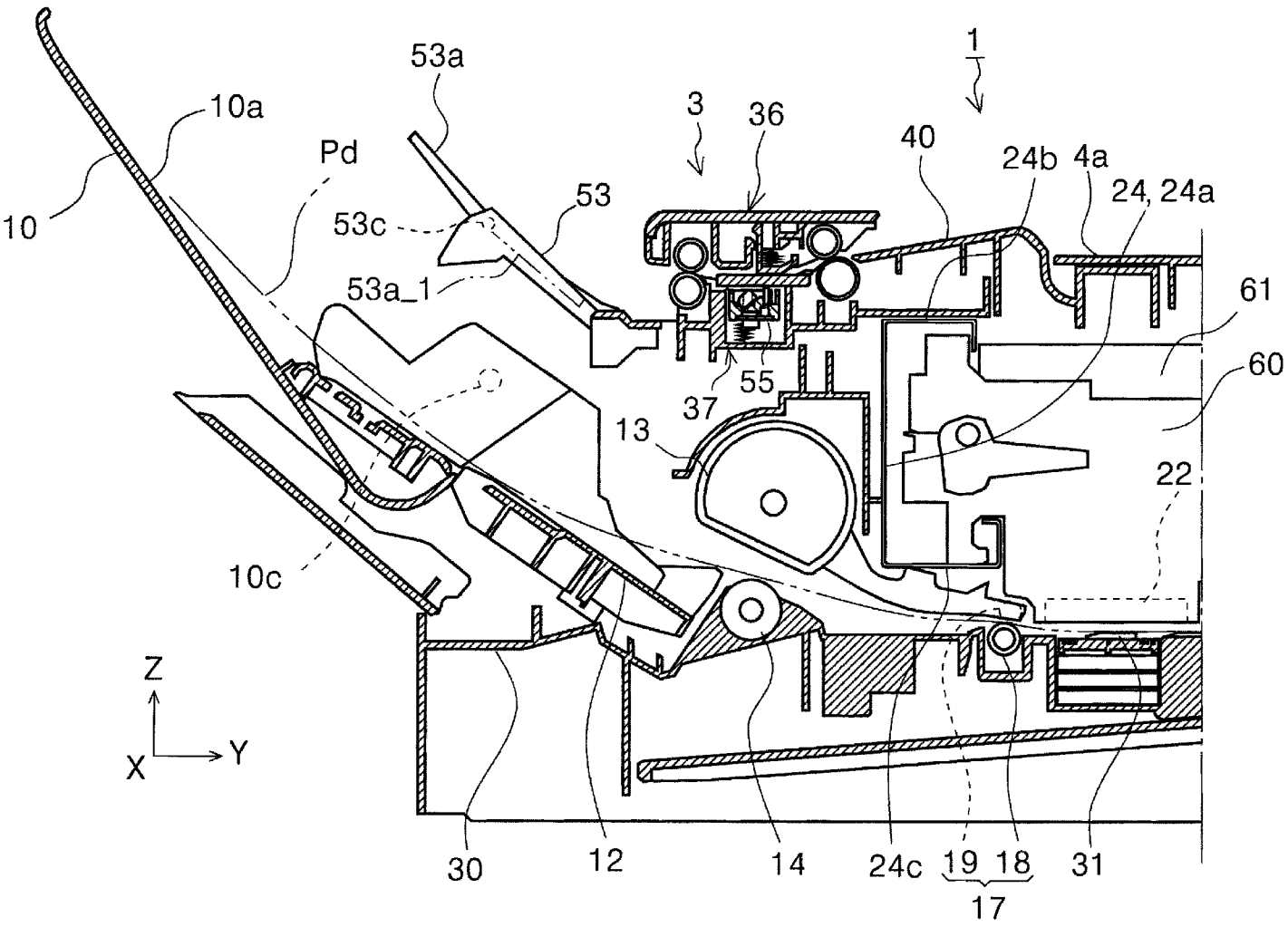
FIG. 12 is a side cross-sectional view of a printer in which a rear top cover and a front top cover are closed.

On the rear side on the apparatus upper surface, a rear top cover 10 is disposed. The rear top cover 10 can be turned around a rotation shaft 10*c* (see FIG. 11 and FIG. 12) to a closed position as illustrated in FIG. 1 and FIG. 11 or to an open position as illustrated in FIG. 2 and FIG. 12. Opening the rear top cover 10 exposes the reading mechanism section 3 as illustrated in FIG. 2, enabling the reading mechanism section 3 to perform reading processing. Furthermore, opening the rear top cover 10 enables the user to set recording paper onto a supporting member 12. The arrow A in FIG. 2 indicates a direction in which recording paper is set.

With reference to FIG. 11 and FIG. 12, a path for transporting recording paper in the apparatus body 2 will be described. On the apparatus rear side, the supporting member 12 is disposed. A recording sheet to be fed is supported in an inclined state by the supporting member 12 and a sheet support surface 10*a* that is a rear side of the rear top cover 10 in an open state as illustrated in FIG. 12. The supporting member 12 can swing about a pivot shaft (not illustrated), and the swinging of the supporting member 12 moves the supported recording sheet forward or backward with respect to a feeding roller 13.

The feeding roller 13 is driven to rotate by a motor (not illustrated), and the rotating of the feeding roller 13 feeds the recording sheet downstream. A separation roller 14 that has a rotation resistance is disposed to face the feeding roller 13. The separation roller 14 and the feeding roller 13 forms a nipping area therebetween to prevent or reduce multi-sheet feeding of recording sheets. The chain double-dashed line Pd in FIG. 12 indicates a trajectory of a recording sheet that is fed and transported by the feeding roller 13.

The recording sheet that has been fed by the feeding roller 13 reaches a transport roller pair 17. The transport roller pair 17 includes a drive roller 18 that is driven by a drive source (not illustrated) and a driven roller 19 that is driven to rotate. The recording sheet is nipped by the rollers and transported to an area facing the recording head 22, that is, a recording area for recording, where recording is performed.

The carriage 60 that has the recording head 22 is powered by a power source (not illustrated) and reciprocated in the X-axis direction while being guided by a main frame 24 that extends in the X-axis direction. The recording head 22 discharges an ink onto a recording sheet as the carriage 60 moves. On the carriage 60, the ink tank 61 is mounted, and from the ink tank 61, an ink is supplied to the recording head 22. The ink tank 61 according to the embodiment has an ink supply portion (not illustrated), and through the ink supply port, the ink tank 61 can be refilled with the ink. The refilling of the ink tank 61 with the ink will be described in detail below.

The main frame 24 is made of a metal plate, and has a vertical portion 24*a*, a first horizontal portion 24*b*, and a second horizontal portion 24*c*. The vertical portion 24*a* serves as a frame surface that intersects the horizontal direction in side view. The first horizontal portion 24*b* is formed by bending an upper portion of the vertical portion 24*a*. The second horizontal portion 24*c* is formed by bending a lower portion of the vertical portion 24*a*. The vertical portion 24*a* according to the embodiment extends along a vertical plane. The first horizontal portion 24*b* and the second horizontal portion 24*c* according to the embodiment extend along a horizontal plane. In the main frame 24, a +Y-direction end portion of the first horizontal portion 24*b* is bent in the −Z direction, a +Y-direction end portion of the second horizontal portion 24*c* is bent in the +Z direction, and furthermore, an upper end portion of the +Y-direction end portion is slightly bent in the −Y direction, forming a rectangle space as a whole in side view. A part of the carriage 60 is disposed in the space, and the part inside the space is guided by the main frame 24 along the X-axis direction.

Figure 6:
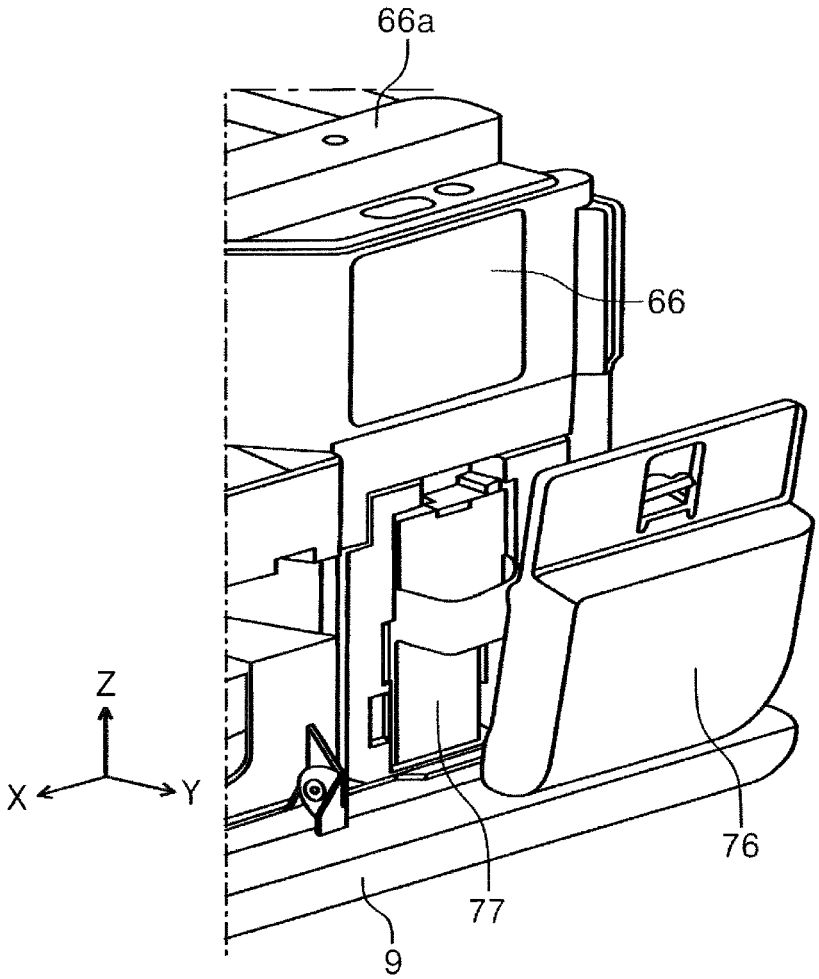
FIG. 6 is a perspective view of a waste liquid cover that is open.

At a position facing the recording head 22, a support rib 31 is disposed, and a recording sheet to be recorded by the recording head 22 is supported by the support rib 31. The support rib 31 according to the embodiment is surrounded by a recessed portion (not illustrated). In the recessed portion, an ink absorbing material (not illustrated) is disposed to absorb an ink that is discharged onto an area off the end portions of a sheet with no margins in the sheet end portions in printing. The absorbed ink is guided along an ink channel (not illustrated) to a waste liquid tray 77 illustrated in FIG. 6. The waste liquid tray 77 can be detached after the front cover 9 is opened and a waste liquid cover 76 is opened.

Returning to FIG. 11, on a downstream side of the supporting member 12 in the transport direction, a discharging roller pair 26 for discharging a recorded recording sheet toward the apparatus front is disposed. The discharging roller pair 26 includes a drive roller 27 that is driven by a drive source (not illustrated) and a driven roller 28 that is driven to rotate. A recording sheet is nipped by the rollers and transported toward the apparatus front side and supported by the discharge tray 29 that has been extended.

In the above description, the structure of the apparatus body 2 has been described. Hereinafter, the reading mechanism section 3 that is disposed on an upper part of the apparatus body 2 will be described with reference to FIG. 13. The reading mechanism section 3 includes an input tray 40, an upper unit 36, a lower unit 37, and a discharge tray 53.

A leading edge of a document to be read is supported by the input tray 40 and a trailing edge of the document is supported by the upper surface 4*a* of the front top cover 4 (see FIG. 2). The arrow B in FIG. 2 indicates a direction in which a document to be read is set. In FIG. 2, a document Gp is set and is supported by the input tray 40 and the upper surface 4*a* of the apparatus body 2. In FIG. 2, edge guides 38*a* and 38*b* guide side ends of a document that is set. Returning to FIG. 13, a document transport direction in document reading in the reading mechanism section 3 is approximately the −Y direction, and on a downstream side of the input tray 40 in the document transport direction, a transport roller pair 41 is disposed. The transport roller pair 41 includes a drive roller 42 that is driven by a drive source (not illustrated) and a driven roller 43 that is driven to rotate. A document is nipped by the rollers and transported downstream.

On a downstream side of the transport roller pair 41 in the document transport direction, a reading glass 58 is disposed. Below the reading glass 58, a sensor module 55 that serves as a reading section is disposed. The sensor module 55 extends in the X-axis direction and is pressed against a lower surface of the reading glass 58 by a pressing spring 57 from under the reading glass 58. The sensor module 55 may be a charge-coupled device (CCD) module, or a contact image sensor (CIS) module, and in this embodiment, a CIS module is used. A circuit board 56 has a light receiving element (not illustrated) and a light emitting element (not illustrated). The sensor module 55 is held by the holding frame 54, and the holding frame 54 serves as a base of the lower unit 37 and is a lowermost surface of the lower unit 37.

Above the reading glass 58, a pressing member 45 is disposed. The pressing member 45 is pressed against the reading glass 58 by a compression spring 46. A document transported by the transport roller pair 41 is read by the sensor module 55 while being held by the pressing member 45 and the reading glass 58. The driven roller 43, the pressing member 45, the compression spring 46, and a driven roller 50 are disposed in a holding frame 51 that serves as a base of the upper unit 36.

On a downstream side of the reading glass 58, a discharging roller pair 48 for discharging a recorded document is disposed. The discharging roller pair 48 includes a drive roller 49 that is driven by a drive source (not illustrated) and the driven roller 50 that is driven to rotate. A read document is nipped by the rollers and discharged toward the discharge tray 53. A line Gr indicates a trajectory of a document that is set, read, and discharged.

Figure 13:
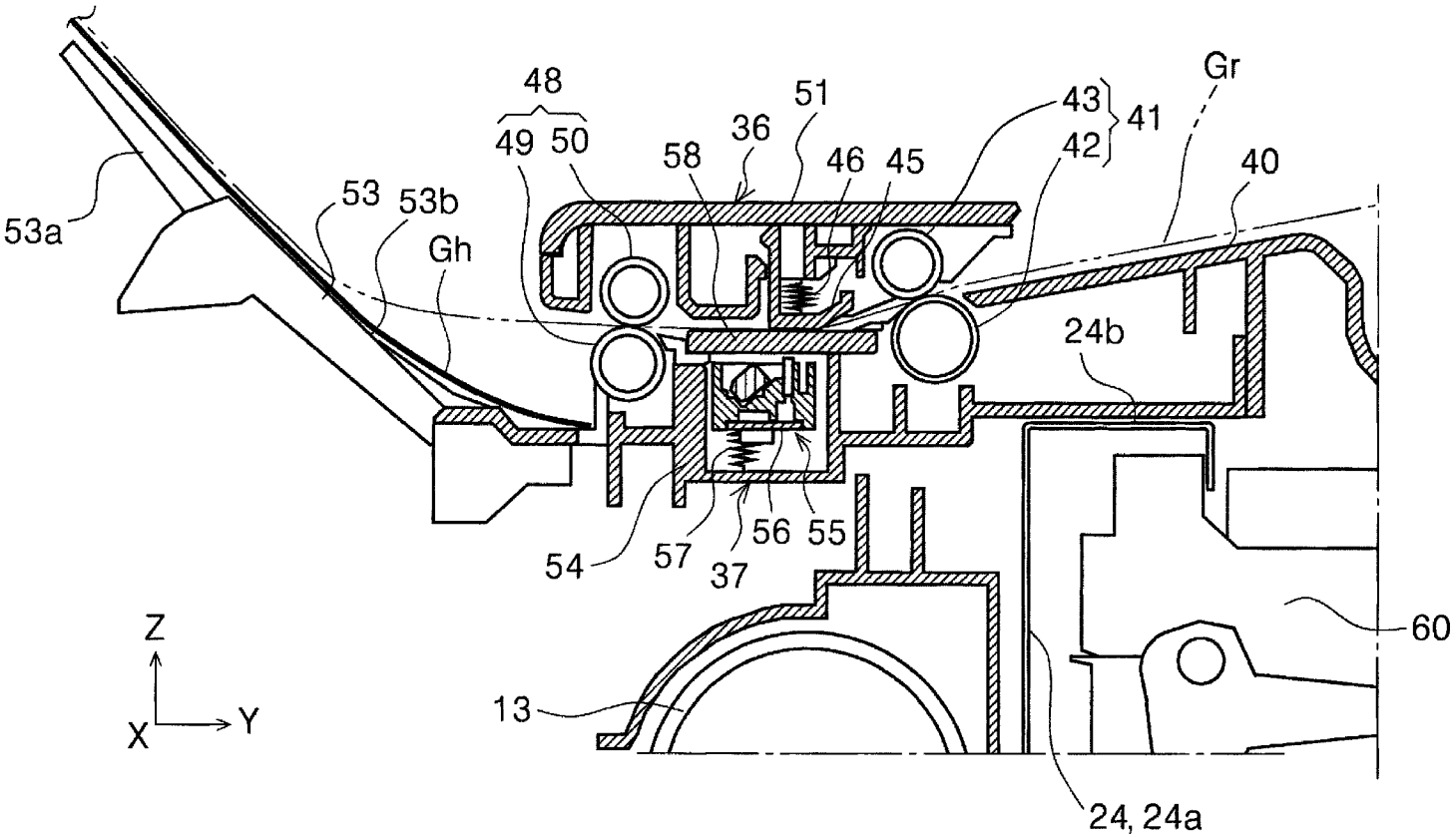
FIG. 13 is an enlarged view of a part of the printer in FIG. 12.

The discharge tray 53 that serves as a document support tray can be slid in an oblique up-down direction to a non-extended state illustrated in FIG. 11 or to an extended state illustrated in FIG. 2, FIG. 12, and FIG. 13, and a sub tray 53*a* can also be extended. The sub tray 53*a* can be turned about a rotation shaft 53*c* in the clockwise direction or the counterclockwise direction in FIG. 12 to the extended state indicated by the solid line or to the retracted state indicated by the double-dashed line 53*a*_1 in FIG. 12. In a case of a long document, its leading edge is discharged over the discharge tray 53 and is supported by the sheet support surface 10*a* of the rear top cover 10, which is disposed behind the discharge tray 53. The solid line Gh in FIG. 13 indicates a document being supported by the discharge tray 53. FIG. 13 also illustrates a document support surface 53*b*.

The above-described driven roller 43, the pressing member 45, the compression spring 46, the driven roller 50, and the holding frame 51 are included in the upper unit 36. The upper unit 36 can be turned about a rotation shaft (not illustrated) with respect to the lower unit 37, and opening the upper unit 36 allows a document being nipped by the transport roller pair 41 and the discharging roller pair 48 to be released. The above-described drive roller 42, the sensor module 55, the drive roller 49, and the holding frame 54 are included in the lower unit 37.

Next, refilling of the ink tank 61 with ink will be described. As illustrated in FIG. 3, FIG. 4, and FIG. 10, opening the front top cover 4 exposes the carriage 60 and the ink tank 61 that is mounted on the carriage 60. The ink tank 61 includes ink tanks 61A, 61B, 61C, and 61D, and in this specification, the ink tanks may be collectively referred to as "ink tank 61" unless otherwise specified. The ink tanks 61 can respectively store inks of different colors, for example, a black ink, a cyan ink, a magenta ink, and a yellow ink. The ink tanks 61 are disposed along the X-axis direction.

The ink tank 61 has an open/close lever at a top, specifically, the ink tank 61A has an open/close lever 62A, the ink tank 61B has an open/close lever 62B, and the ink tank 61C has an open/close lever 62C, and the ink tank 61D has an open/close lever 62D. Hereinafter, the open/close levers may be collectively referred to as "open/close lever 62" unless otherwise specified. Opening the open/close lever 62 exposes an ink injection port (not illustrated), and from the ink injection port, the ink can be injected into the ink tank 61.

Figure 5:
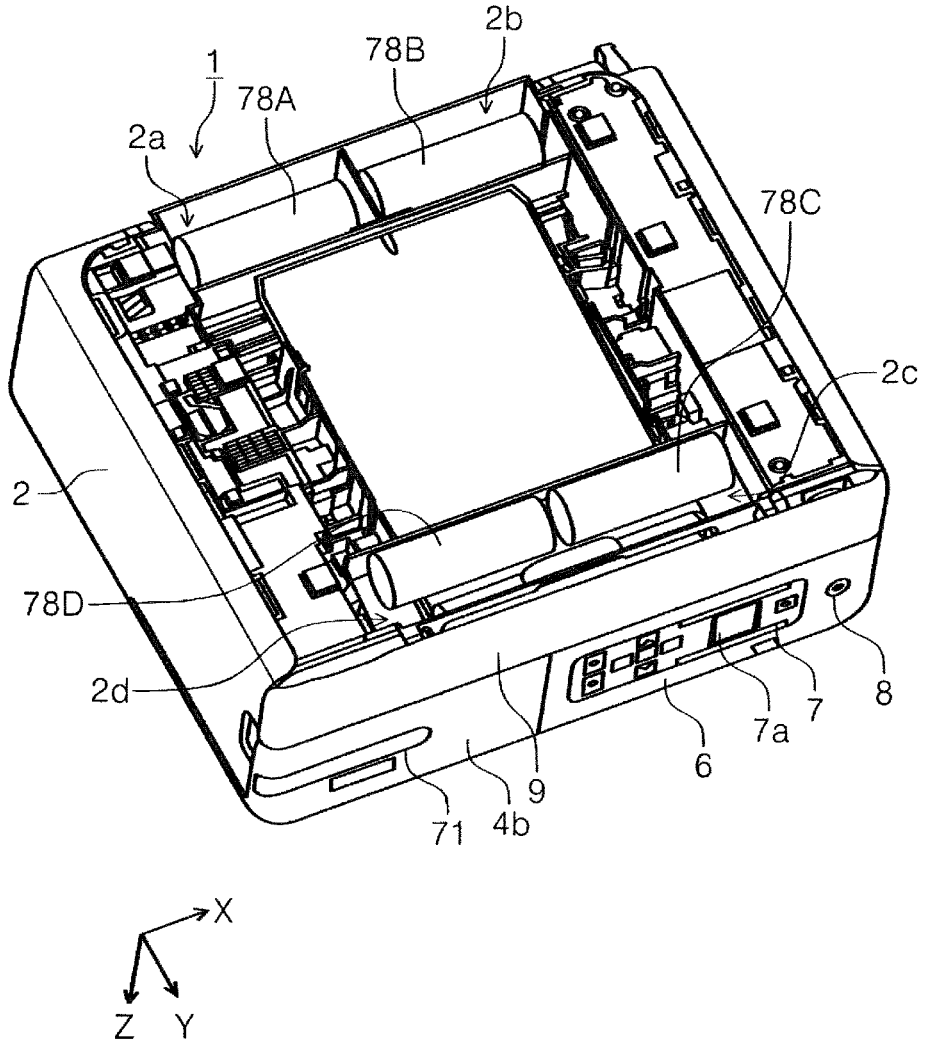
FIG. 5 is a perspective view of a bottom of a printer.

Ink bottles that contain inks of different colors can be stored in an apparatus bottom section as illustrated in FIG. 5. In FIG. 5, recessed portions 2*a*, 2*b*, 2*c*, and 2*d* are provided in the apparatus bottom section. In the recessed portions 2*a*, 2*b*, 2*c*, and 2*d*, ink bottles 78A, 78B, 78C, and 78D that store the inks for refill can be disposed. Before the shipment of the printer 1 from a factory, in a packing box, the ink bottles 78A, 78B, 78C, and 78D are disposed in the recessed portions 2*a*, 2*b*, 2*c*, and 2*d* respectively. Accordingly, with this structure, the dimensions of the packing box can be reduced.

Figure 15:
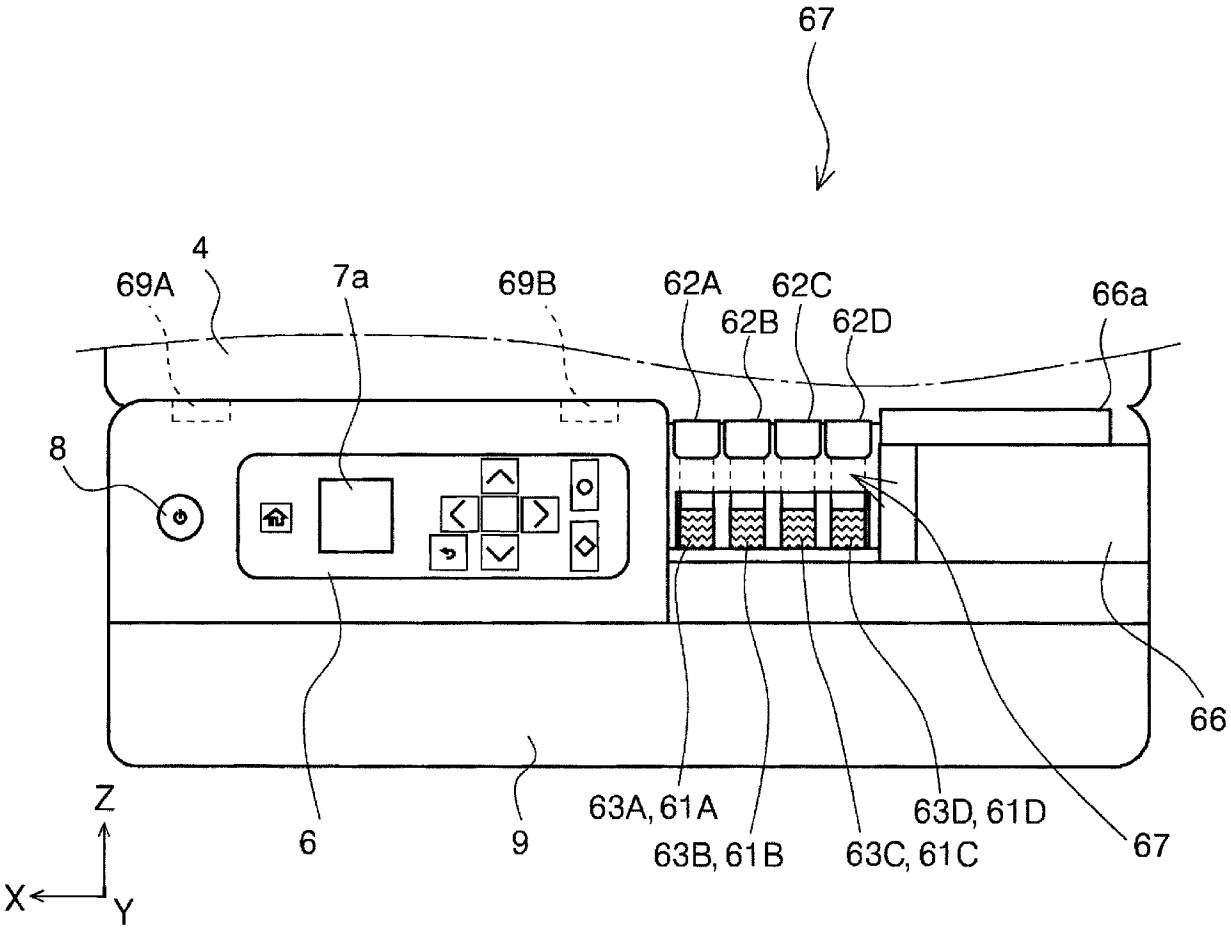
FIG. 15 is a front view of a printer in which a front top cover and a front cover are closed.

The ink tank 61 has a liquid level check portion on the front side, that is, on the side surface in the +Y direction, more specifically, as illustrated in FIG. 15, the ink tank 61A has a liquid level check portion 63A, the ink tank 61B has a liquid level check portion 63B, the ink tank 61C has a liquid level check portion 63C, and the ink tank 61D has a liquid level check portion 63D. Hereinafter, the liquid level check portions may be collectively referred to as "liquid level check portion 63" unless otherwise specified.

The ink tank 61 is made of a material through which light can pass, enabling the user to externally and visually check the liquid level of the ink in the ink tank 61 through the liquid level check portion 63. The ink tank 61 may be made of, for example, a colorless and transparent resin material or a whitish resin material. The ink tank 61 made of a whitish resin material provides a high contrast to the color of the ink inside the ink tank, enabling the user to readily and visually check the liquid level of the ink. The casing of the carriage 60 has an opening in a portion that corresponds to the liquid level check portion 63 such that the user can visually check the liquid level check portion 63 from outside.

Figure 14:
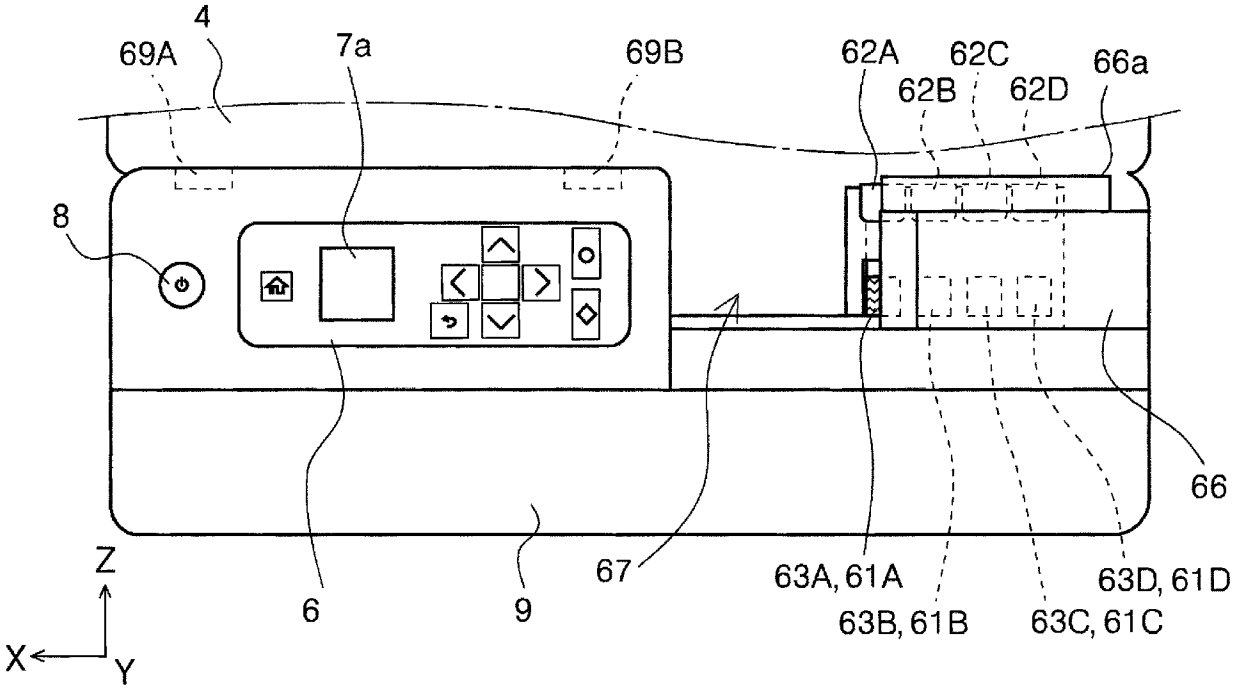
FIG. 14 is a front view of a printer in which a front top cover and a front cover are closed.

As illustrated in FIG. 3, on the +Y direction side with respect to the movement area of the carriage 60, a right wall section 66, which is a first wall section, and a left wall section 65, which is a second wall section, are disposed. The left wall section 65 and the right wall section 66 are disposed along the vertical direction, and the right wall section 66 is disposed at an end portion in the −X direction. In this embodiment, a home position of the carriage 60 is set at the end portion in the −X direction, and when the apparatus is in a non-operating state, the carriage 60 is positioned at the end portion in the −X direction as illustrated in FIG. 3, FIG. 4, and FIG. 14. In the home position, a capping mechanism (not illustrated) is disposed, and capping is performed to the recording head 22 by the capping mechanism. The left wall section 65 is disposed with respect to the right wall section 66 with a predetermined space in the +X direction. Between the left wall section 65 and the right wall section 66, an exposure section 67 is provided. The exposure section 67 is, specifically, a space between the right wall section 66, which is close to the home position of the carriage 60, and the left wall section 65, which is farther from the home position than the right wall section 66.

To the left wall section 65, the tilt panel 6 is attached with the left hinge 69A and the right hinge 69B illustrated in FIG. 14 and FIG. 15. The tilt panel 6 is disposed, specifically, such that the tilt panel 6 can be tilted with respect to the left wall section 65 with the right hinge 69B, which is a first hinge, and the left hinge 69A, which is farther from the exposure section 67 than the right hinge 69B and is a second hinge. Between the left hinge 69A and the right hinge 69B, the left hinge 69A is a torque hinge that can keep a tilt angle of the tilt panel 6. With this structure, the following operational advantage can be achieved. This structure has the exposure section 67, that is, the space in the −X direction with respect to the left wall section 65, and the −X direction side of the left wall section 65 has no support and tends to be readily bent. Accordingly, if a torque hinge is used at this position, the left wall section 65 would be bent due to the torque produced when the tilt panel 6 is tilted. However, in this embodiment, of the left hinge 69A and the right hinge 69B, the left hinge 69A is a torque hinge configured to keep a tilt angle of the tilt panel 6, and thus bending of the left wall section 65 can be reduced in tilting the tilt panel 6.

Figure 16:
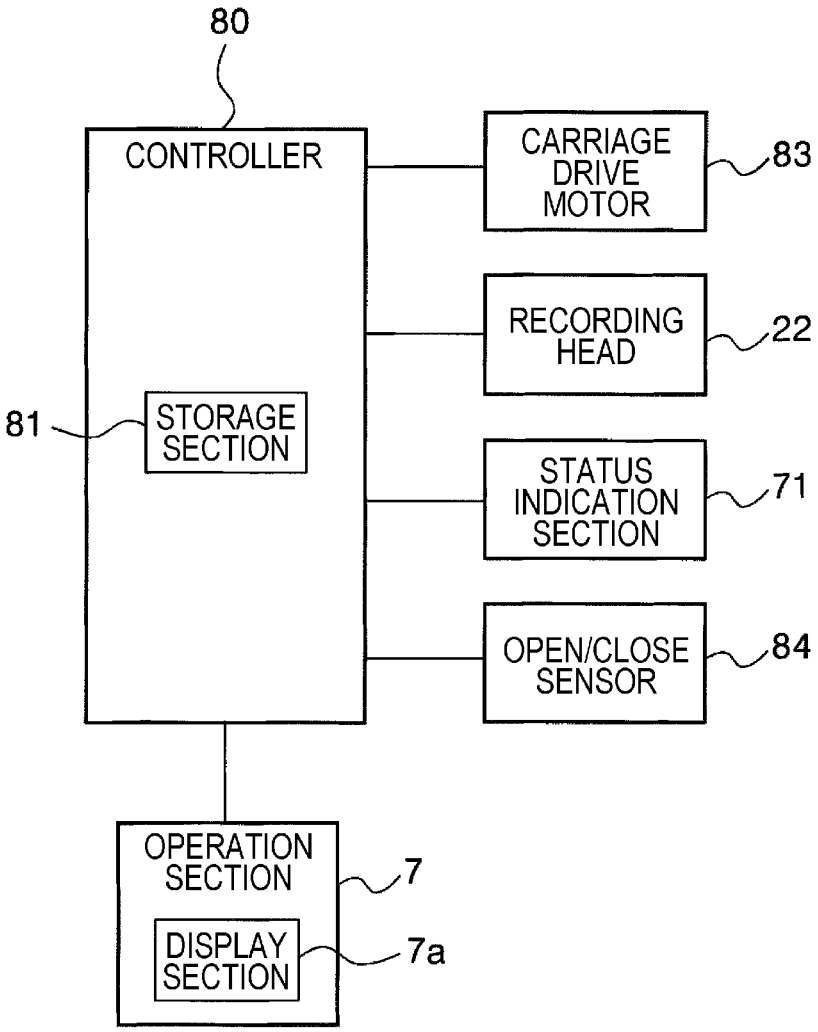
FIG. 16 is a block diagram of a control system.

Next, the operation of the carriage 60 to be performed to refill the ink tank 61 with ink will be described. As illustrated in FIG. 16, the controller 80 that performs various control processes of the printer 1 controls a carriage drive motor 83, which is a power source of the carriage 60, the recording head 22, the status indication section 71, and the display section 7*a* of the operation section 7. The controller 80 includes a storage section 81, and the storage section 81 stores various programs necessary for the control of the printer 1 and various kinds of information necessary for the control of the printer 1. The controller 80 counts the number of dots of discharged ink in controlling the recording head 22, and based on the counted value, calculates ink levels of respective ink tanks 61, and stores the calculated ink levels in the storage section 81. When the ink level has decreased to a predetermined level, the controller 80 instructs the status indication section 71 to blink to inform that the ink level has decreased to the predetermined level.

Figure 17:
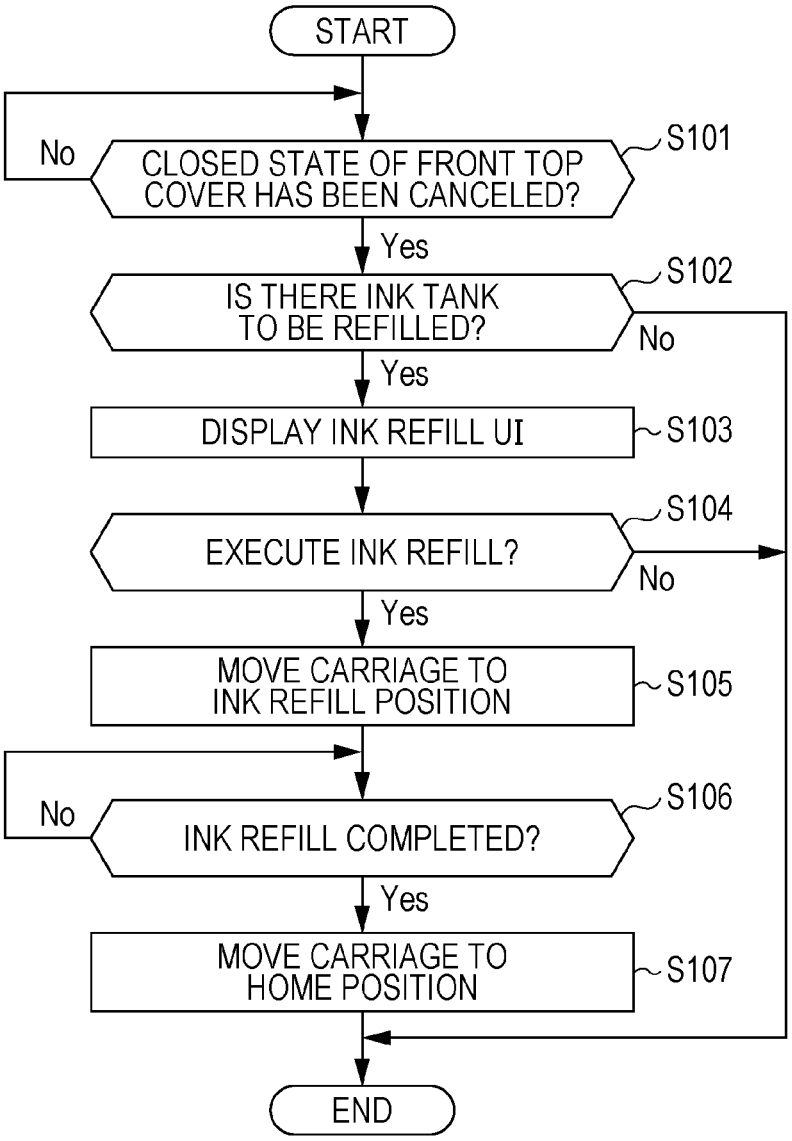
FIG. 17 is a flowchart illustrating control processing performed by a controller in ink refilling.

Hereinafter, control processing to be performed by the controller 80 in ink refilling will be described with reference to FIG. 17. When the front top cover 4 is opened by a user, based on a detection signal from the above-described opening/closing detection sensor (not illustrated), the controller 80 detects that the closed state of the front top cover 4 has been canceled (Yes in step S101). Then, the controller 80 determines whether ink levels of the ink tanks 61 have reached a predetermined level, that is, whether there is an ink tank 61 to be refilled (step S102). If there is an ink tank 61 to be refilled with ink (Yes in step S102), the controller instructs the display section 7*a* of the operation section 7 to display an ink refill user interface (step S103). The ink refill user interface is hereinafter referred to as an ink refill UI.

The ink refill UI may include, for example, displaying the color of the ink to be refilled and displaying a confirmation message such as "Refill the ink tank with ink?". When the user presses down an OK button, the controller 80 determines that the user wants to refill the ink tank with ink (Yes in step S104), and then the controller 80 instructs the carriage 60 in the home position to move to an ink refill position (step S105). The ink refill position of the carriage 60 is a position in which all of the liquid level check portions 63 can be visually checked through the exposure section 67 as illustrated in FIG. 15, and a position to which the carriage 60 is moved by a predetermined amount in the +X direction from the home position.

A cover portion 66*a* is formed at an upper end of the right wall section 66 as illustrated in FIG. 3, and the cover portion 66*a* covers a part of the open/close lever 62. More specifically, the end portion of the open/close lever 62 in the +Y direction is covered such that the open/close lever 62 is prevented from being opened when the carriage 60 is in the home position. Accordingly, when the carriage 60 is in the home position, ink refilling to the ink tank 61 is not allowed.

The carriage 60 is moved from the home position to the ink refill position, and then, as illustrated in FIG. 15, all of the open/close levers 62 are out of the cover portion 66*a*, and all of the open/close levers 62 can be opened. With this structure, the open/close lever 62 can be opened to refill the ink tank 61 with ink. As described above, all of the liquid level check portions 63 can be visually checked through the exposure section 67.

Consequently, the user can refill the ink tank 61 with ink while checking the liquid level check portion 63.

After the completion of step S105, the controller 80 changes the display on the ink refill UI, for example, to a message "Ink refill completed?". When the user presses down the OK button to respond to the massage, the controller 80 determines that the ink refill operation by the user has been completed (Yes in step S106), and returns the carriage 60 from the ink refill position to the home position and sets the ink level information about the ink tank 61 that has been refilled to a full state, which means a highest ink level. Note that by using the above-described open/close sensor 84 for detecting that the front top cover 4 has been closed, the controller 80 may return the carriage 60 to the home position in response to a detection of a closed state of the front top cover 4.

As described above, the printer 1 includes the tilt panel 6 on the apparatus front side, which is the side along the X-axis direction, and in a front view of the apparatus front side, from the end portion in the +X direction toward the −X direction, the tilt panel 6, the exposure section 67 for exposing the liquid level check portion 63, and the home position of the carriage 60 are disposed in this order. The carriage 60 is moved from the home position toward the exposure section 67, and thereby the arrangement of the tilt panel 6 and the liquid level check portion 63 is changed along the X-axis direction in the front view of the apparatus front side as illustrated in FIG. 14 and FIG. 15.

In this structure, in an ink injection operation for injecting an ink into the ink tank 61, the liquid level check portion 63 becomes close to the tilt panel 6, and thus the user turns his/her eyes less frequently while operating the tilt panel 6 and injecting the ink. Accordingly, the user can more readily inject the ink.

In this embodiment, above the carriage 60, the front top cover 4 that serves as a top panel of the apparatus when the front top cover 4 is closed and exposes the upper portion of the carriage 60 when the front top cover 4 is open is provided. The front top cover 4 has the side surface forming section 4*b* that serves as the apparatus front side together with the tilt panel 6 when the front top cover 4 is closed. When the front top cover 4 is closed, the side surface forming section 4*b* covers the exposure section 67, and when the front top cover 4 is open, the side surfaces forming section 4*b* exposes the exposure section 67. This structure prevents dust from entering the inside of the apparatus through the exposure section 67 even though the exposure section 67 has the opening. Furthermore, the exposure section 67 that has the opening enables users to directly and visually check the liquid level check portion 63, and as compared with the exposure section 67 made of, for example, a transparent plate, the visibility of the liquid level check portion 63 can be increased and the liquid level of the ink in the ink tank 61 can be visually and more reliably checked. Furthermore, in a case in which the side surface forming section 4*b* is a single component and is opened or closed, in addition to an open/close operation of the front top cover 4, an open/close operation of the side surface forming section 4*b* is to be performed. However, since the side surface forming section 4*b* is provided together with the front top cover 4, the space above the carriage 60 can be exposed and the exposure section 67 can be exposed by a single operation, and thus the operability can be increased.

The front top cover 4 according to the embodiment has a wire cover 74 that covers a wire 73 that is electrically coupled to a light emission unit 72. The light emission unit 72 is included in the status indication section 71 illustrated in FIG. 1 to FIG. 3. A portion 74*a* of the wire cover 74 that extends in the X-axis direction is close to the rotation shaft of the front top cover 4, and the center of gravity of the front top cover 4 is close to the rotation shaft of the front top cover 4. The center of gravity of the front top cover 4 is indicated by reference numeral G in FIG. 10. "The center of gravity G is close to the rotation shaft of the front top cover 4" means that the center of gravity G in FIG. 10 is closer to the side of the right-shaft section 54*c* and the left-shaft section 54*b* than a middle position CL between the right-shaft section 54*c* and the left-shaft section 54*b* and the side surface forming section 4*b* at a free end is. With this structure, the impact due to the front top cover 4 that is closed unintentionaly can be suppressed.

The front top cover 4 according to the embodiment can be opened from the closed state to an open limit by being turned to a rotation angle larger than 90° as illustrated in FIG. 10. More specifically, the front top cover 4 according to the embodiment can be opened from a horizontally closed state to the open limit in FIG. 10 by turning the front top cover 4 to 112.5°. With this structure, the front top cover 4 can be reliably kept open.

When the front top cover 4 is turned to the open limit, if the rear top cover 10 is closed, the front top cover 4 can be supported by the +Y-direction end portion of the rear top cover 10. When the front top cover 4 is turned to the open limit, if the rear top cover 10 is open, the front top cover 4 can be supported by contact sections 3*c* (see FIG. 2) that are the +Y-direction end portions of the reading mechanism section 3.

In this embodiment, as illustrated in FIG. 10, the right-shaft section 54*c* and the left-shaft section 54*b*, which serve as the rotation shaft of the front top cover 4, are closer to the +Y direction side than the main frame 24 in the Y-axis direction is. With this structure, when the front top cover 4 is open, the main frame 24 is disposed at a position closer to the −Y direction side. The main frame 24 has a linear scale (not illustrated) for detecting a position of the carriage 60. The linear scale may become dirty when the user touches the linear scale, and then, a detection error may occur. However, when the front top cover 4 is open, since the main frame 24 is disposed at the position closer to the −Y direction side as described above, the above-mentioned problem can be prevented or reduced.

Figure 18:
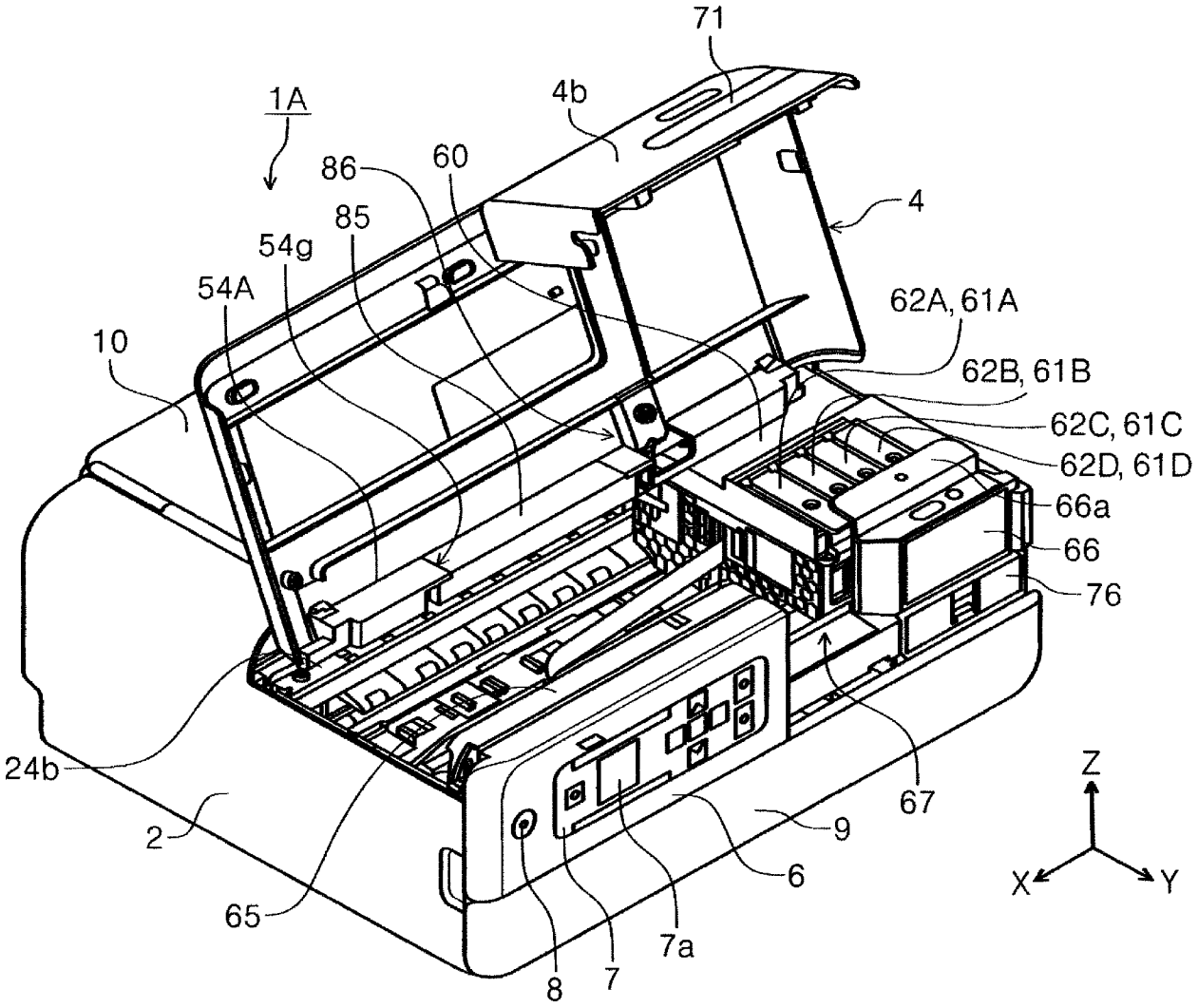
FIG. 18 is a perspective view of a printer according to another embodiment in which a front top cover is open.
Figure 19:
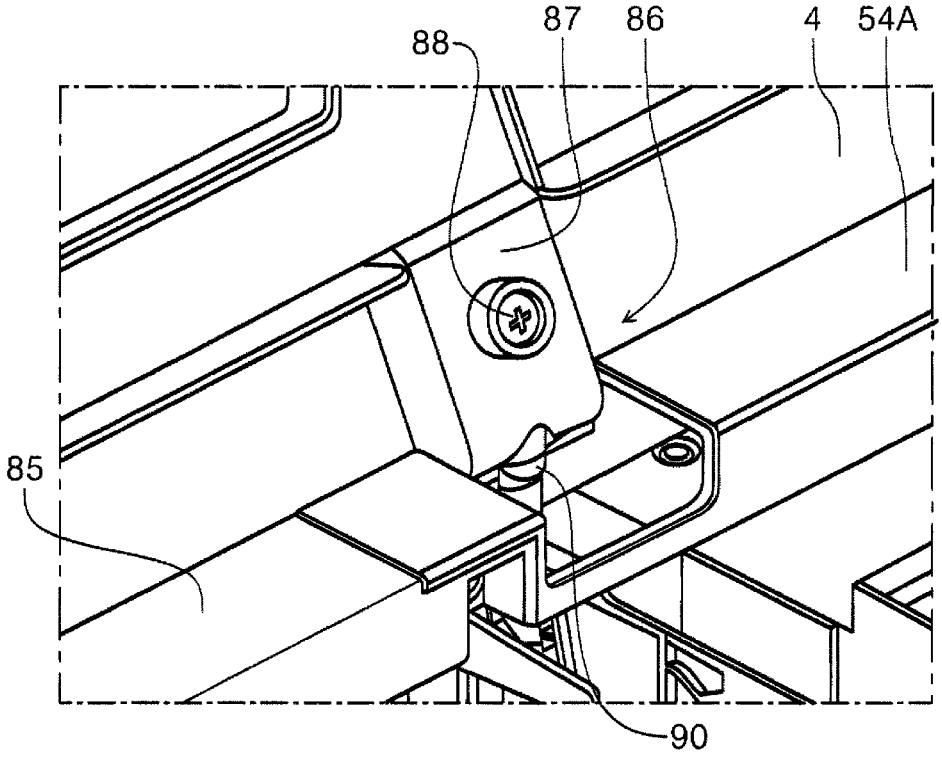
FIG. 19 is a perspective view of a holding member in which a front top cover is open.
Figure 20:
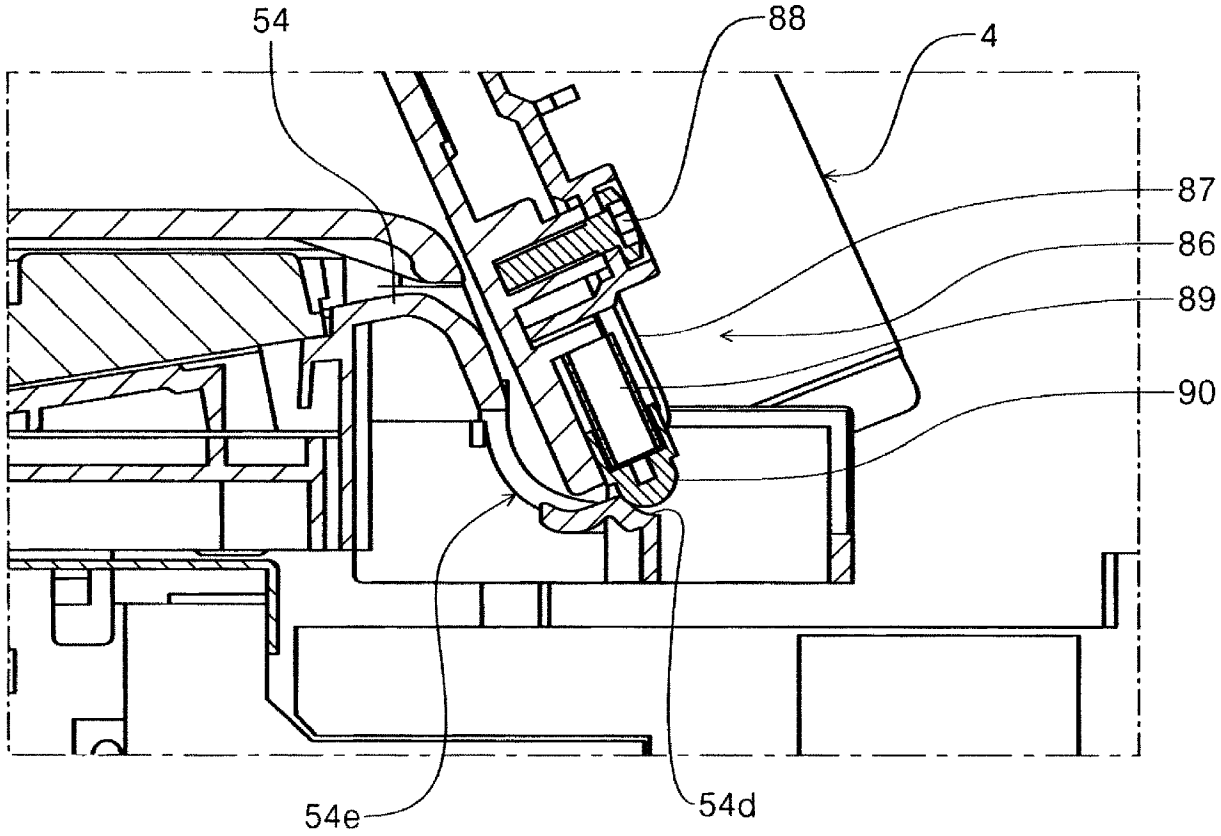
FIG. 20 is a cross-sectional view of a holding member in which a front upper cover is open.
Figure 21:
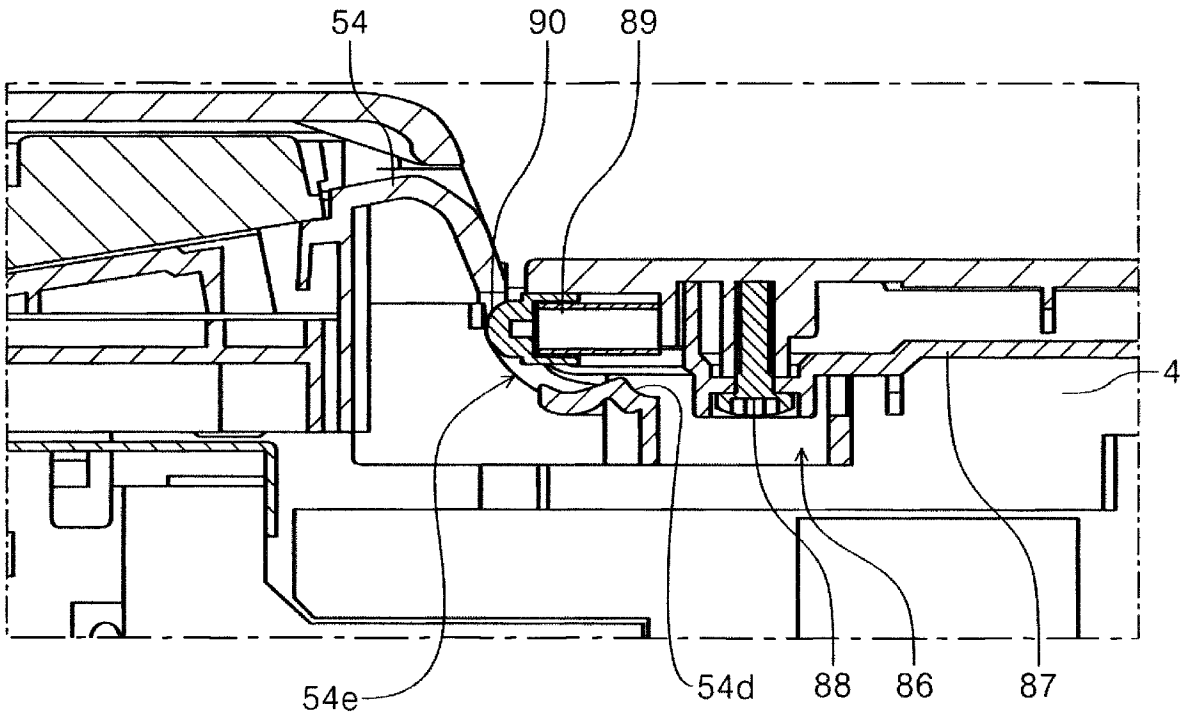
FIG. 21 is a cross-sectional view of a holding member in which a front upper cover is closed.

With reference to FIG. 18 to FIG. 23, other embodiments of the printer will be described. A printer 1A illustrated in FIG. 18 to FIG. 23 is different from the above-described printer 1 in that the printer 1A includes a cover member 85 and a holding member 86. The other components in the printer 1A are similar to those in the above-described printer 1, and their descriptions will be omitted in the description below. The holding member 86 holds an open state of the front top cover 4. The holding member 86 includes a cover member 87 as illustrated in FIG. 19, a plunger 90 as illustrated in FIG. 20 and FIG. 21, and a compression spring 89, which is an example pressing member. A part of the plunger 90 and the compression spring 89 are covered by the cover member 87, and the cover member 87 is fixed to the front top cover 4 by a fixing screw 88.

The plunger 90 can be slid in a direction of the radius of gyration of the front top cover 4, and is pressed against the center of rotation of the front top cover 4 by the compression spring 89. The reference numeral 54A indicates a member that corresponds to the above-described holding frame 54, and the holding frame 54A has an opening 54*e* and a contact portion 54*d*. When the front top cover 4 is closed, the plunger 90 is in the opening 54*e* of the plunger 90 as illustrated in FIG. 21, and no spring force is acting on the holding frame 54A from the compression spring 89.

When the front top cover 4 is opened from this state, the plunger 90 faces and comes in contact with the contact portion 54*d* of the holding frame 54A. In the fully opened state of the front top cover 4 in FIG. 20, the spring force of the compression spring 89 that presses the plunger 90 against the contact portion 54*d* acts to hold the front top cover 4 in the fully opened state. Specifically, the plunger 90 is pressed against the contact portion 54*d* by the spring force of the compression spring 89, and this force causes the holding member 86 to produce the moment in the counter-clockwise direction in FIG. 20 with respect to the front top cover 4. With this structure, the front top cover 4 can be prevented from being unintentionally closed. Furthermore, the front top cover 4 provides tactile response when the user fully open the front top cover 4, and thereby the operability of the user can be increased.

Figure 22:
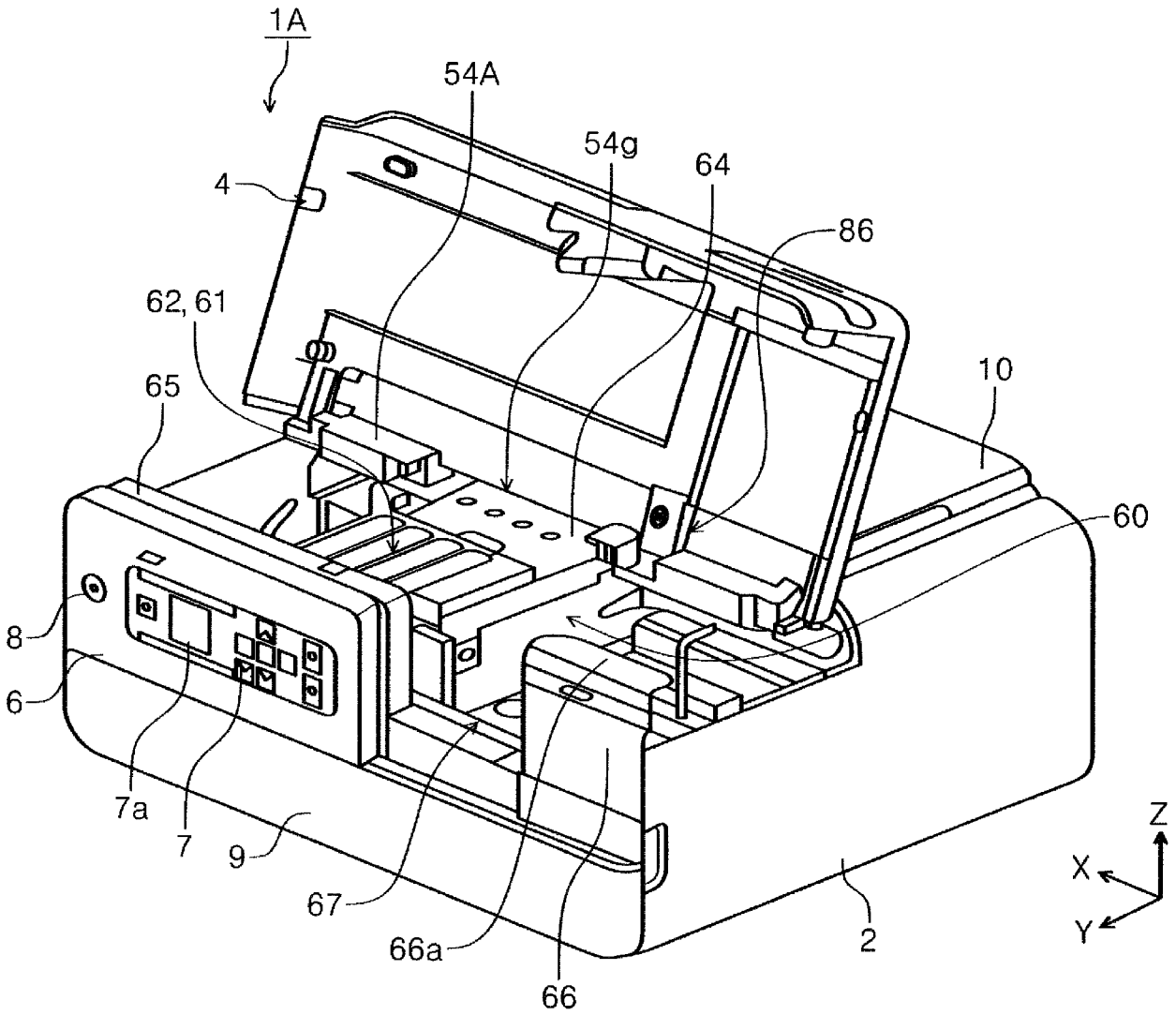
FIG. 22 is a perspective view of a printer according to another embodiment in which a front top cover is open and a cover member is detached.
Figure 23:
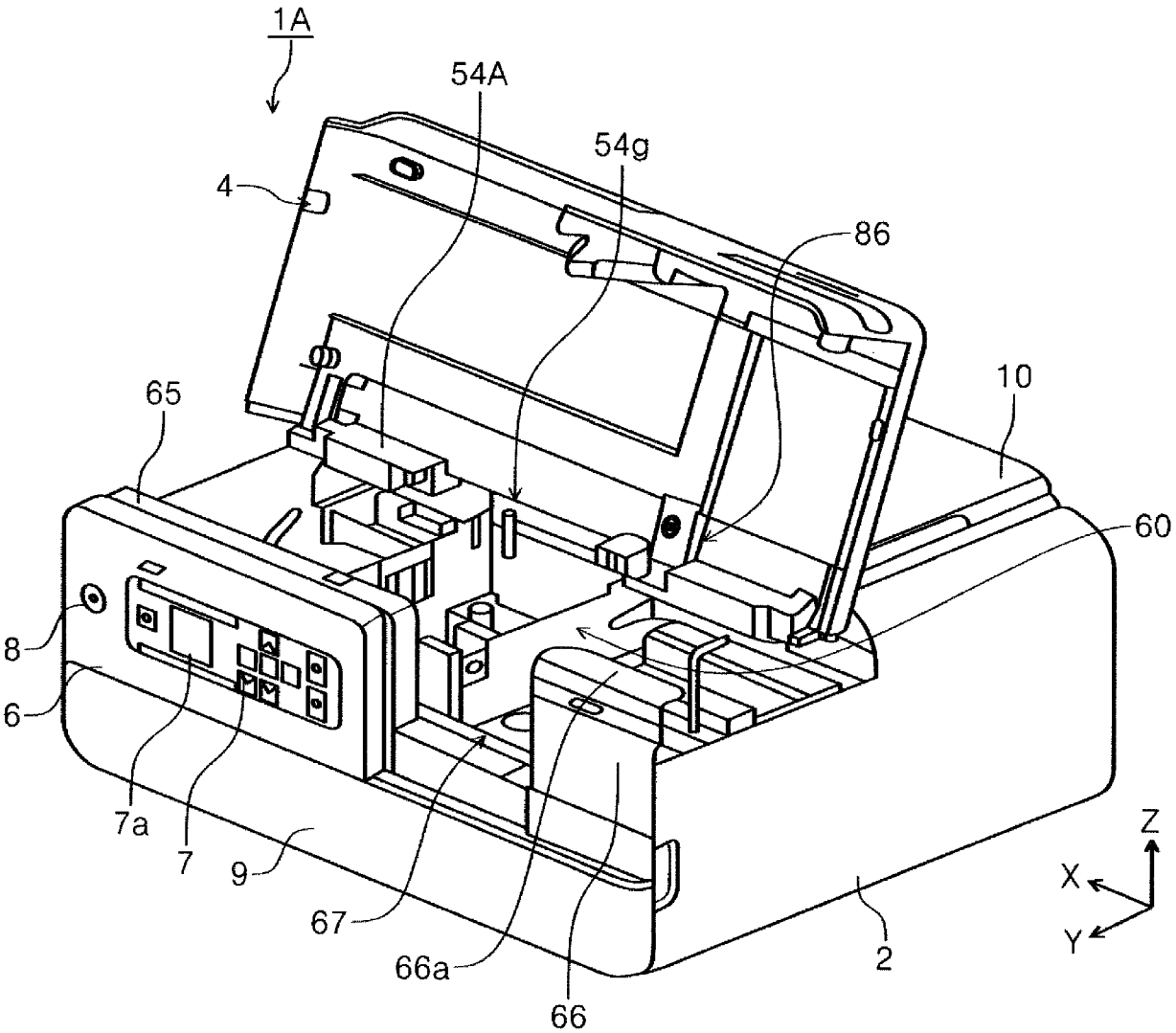
FIG. 23 is a perspective view of a printer according to another embodiment in which a front top cover is open, a cover member is detached, and an upper cover of a carriage and an ink tank are detached.

As illustrated in FIG. 18, FIG. 22, and FIG. 23, the holding frame 54A, which serves as the covering member, has a notch 54*g* that extends in the X-axis direction at an end portion in the +Y direction. To the notch 54*g*, the cover member 85 is fixed by a fixing screw (not illustrated). The carriage 60 has an upper cover 64, and the upper cover 64 can be detached to detach the ink tank 61 and also detach the recording head 22 (see FIG. 11).

When the cover member 85 is attached, a part of the upper cover 64 is covered by the holding frame 54A or the cover member 85 and the upper cover 64 cannot be detached. As illustrated in FIG. 22, however, by detaching the cover member 85, the entire upper cover 64 is exposed while the carriage 60 is located at the position of the notch 54*g*, and thus the user can detach the upper cover 64. Accordingly, the notch 54*g* in the holding frame 54A eliminates complicated disassembly operation in detaching the ink tank 61 or the ink tank 61 and the recording head 22 (see FIG. 11), and thereby the maintainability can be increased.

It is to be understood that the present disclosure is not limited to the above-described embodiments, various modifications can be made within the scope of the following claims, and these modifications are included within the scope of the disclosure.

What is claimed is:

1. A recording apparatus comprising:

a carriage configured to be moved in a first direction that is one of directions in a width direction intersecting a transport direction of a recording medium and in a second direction that is an opposite direction of the first direction;

a liquid container provided on the carriage and in which a liquid is to be injected, the liquid container having a liquid level check portion through which a level of the liquid in the liquid container is visually checked;

a recording head disposed in the carriage, the recording head into which the liquid is supplied from the liquid container, and the recording head being configured to discharge the liquid onto the recording medium; and an operation panel disposed on a side surface of the apparatus along the width direction, wherein when the apparatus side surface is viewed from a front side, the operation panel and an exposure section through which the liquid level check portion is exposed are disposed such that the operation panel and the exposure section are visually checked, the carriage is moved from a home position in which the carriage is capped by the recording head toward the exposure section and the operation panel and the liquid level check portion are arranged in the width direction when the apparatus side surface is viewed from the front side, the exposure section where the liquid is to be injected into the liquid container is a location separate from the home position, above the carriage, a top cover that serves as a top panel of the apparatus when the top cover is closed and exposes an upper portion of the carriage when the top cover is open is disposed, the top cover has a side surface forming section that serves as the apparatus side surface together with the operation panel, and when the top cover is closed, the side surface forming section covers the exposure section, and when the top cover is open, the side surface forming section exposes the exposure section.

2. The recording apparatus according to claim 1, wherein when the apparatus side surface is viewed from the front side, from an end portion in the second direction toward the first direction, the operation panel, the exposure section, and the home position are disposed in this order.

3. The recording apparatus according to claim 1, wherein the exposure section is a space between a first wall section located at an end in the first direction and a second wall section located in the second direction with respect to the first wall section, and the operation panel is configured to be tilted with respect to the second wall section with a first hinge and a second hinge that is farther from the exposure section than the first hinge.

4. The recording apparatus according to claim 3, wherein between the first hinge and the second hinge, the second hinge is a torque hinge that is configured to keep a tilt angle of the operation panel.

5. The recording apparatus according to claim 1, wherein the side surface forming section has a light emitting section configured to light up or blink to indicate a status of the apparatus.

6. The recording apparatus according to claim 5, wherein the top cover has a wire cover that covers a wire that is electrically coupled to the light emitting section, and the center of gravity of the wire cover is close to a rotation shaft of the top cover.

7. The recording apparatus according to claim 1, wherein the top cover is configured to be opened from a closed state to an open limit by being turned to a rotation angle larger than 90°.

8. The recording apparatus according to claim 1, further comprising: an open/close sensor configured to detect a close state of the top cover by being pressed by a protrusion on the side surface forming section, wherein the open/close sensor is disposed in a slit into which the protrusion is inserted, and in a state in which the top cover is closed, the protrusion is engaged in the slit to regulate at least a position of the top cover in the width direction.

9. The recording apparatus according to claim 1, further comprising:

an apparatus body having the carriage; and a document reading mechanism section having a reading section configured to read a document and a document transport section configured to transport the document to the reading section, the document reading mechanism section being disposed in an upper part of the apparatus body, wherein the top cover is rotatably coupled to a frame of the document reading mechanism section.

10. The recording apparatus according to claim 1, further comprising:

a holding section configured to hold the top cover that is open, wherein the holding section is disposed in the top cover, and includes a plunger configured to be slid in a direction of the radius of gyration of the top cover that is opened or closed by being turned, a pressing member disposed in the top cover, the pressing member being configured to press the plunger, and the plunger is pressed against a contact portion disposed to face the plunger to hold the top cover that is open.

11. The recording apparatus according to claim 1, further comprising:

a cover member that covers a part of an upper portion of the carriage along the moving direction of the carriage, wherein the cover member has a notch in a portion in the moving direction of the carriage, and on the notch, a detachable cover member is disposed.

12. The recording apparatus according to claim 1, further comprising:

a capping mechanism where capping is performed to the recording head is disposed in the home position.

13. The recording apparatus according to claim 1, wherein the exposure section is a space between a first wall section located at an end in the first direction and a second wall section located in the second direction with respect to the first wall section.

* * * * *